US007514034B2

(12) United States Patent
Abe et al.

(10) Patent No.: US 7,514,034 B2
(45) Date of Patent: Apr. 7, 2009

(54) CONTAINER CAPABLE OF TRANSPORTING MOLTEN METAL RECEIVED THEREIN TO SEPARATE FACTORY AND METHOD OF PRODUCING THE CONTAINER

(75) Inventors: Tsuyoshi Abe, Toyota (JP); Hitoshi Mizuno, Toyota (JP)

(73) Assignee: Hoei Shokai Co., Ltd., Aichi (JP)

( * ) Notice: Subject to any disclaimer, the term of this patent is extended or adjusted under 35 U.S.C. 154(b) by 510 days.

(21) Appl. No.: 10/516,111

(22) PCT Filed: Jun. 2, 2003 (Under 37 CFR 1.47)

(86) PCT No.: PCT/JP03/06957

§ 371 (c)(1), (2), (4) Date: Aug. 4, 2005

(87) PCT Pub. No.: WO03/101646

PCT Pub. Date: Dec. 11, 2003

(65) Prior Publication Data

US 2007/0013114 A1 Jan. 18, 2007

(30) Foreign Application Priority Data

May 31, 2002 (JP) ..... 2002-160635
Dec. 2, 2002 (JP) ..... 2002-350568

(51) Int. Cl.
*C21C 5/46* (2006.01)
*C21B 7/12* (2006.01)

(52) U.S. Cl. ..... 266/239; 266/45; 266/236; 266/275; 222/590; 222/595

(58) Field of Classification Search ..... 266/45, 266/236, 239, 275; 222/590, 595
See application file for complete search history.

(56) References Cited

U.S. PATENT DOCUMENTS 5,708,257 A 1/1998 Comarteau et al.
2004/0089987 A1 5/2004 Kodama et al.

FOREIGN PATENT DOCUMENTS

JP 03-031063 U 3/1991
JP 08-020826 A 1/1996
JP 08-502451 A 3/1996
JP 2002-081869 * 3/2002
WO WO 01/98004 A1 12/2001

OTHER PUBLICATIONS

International Search Report mailed on Sep. 9, 2003.

* cited by examiner

*Primary Examiner*—Roy King
*Assistant Examiner*—Lois Zheng
(74) *Attorney, Agent, or Firm*—Rader, Fishman & Grauer, PLLC

(57) ABSTRACT

A container capable of transferring molten metal from a factory that produces a molten metals such as molten aluminum alloys and so on to a factory that uses the molten metal while the molten metal being stored therein and supplying the molten metal to a use point using the pressure difference. The container comprises a frame 1*a* and a lining 2 having a passage for flowing the molten metal therein. The passage 34 is being provided at an inside of the frame and at least a part thereof is being surrounded by a member restricting a flow of a gas. The pipe 34 is, for example, made of a metal and inside thereof has a lining layer 34*b* formed with a refractory member. The pipe 34 may be structured with a ceramics. As such structure being adopted, even when a crack and the like is formed in the lining 2 of the container, the flow of a gas is shut off, resulting in stable supply of the molten metal.

16 Claims, 34 Drawing Sheets

CONTAINER CAPABLE OF TRANSPORTING MOLTEN METAL RECEIVED THEREIN TO SEPARATE FACTORY AND METHOD OF PRODUCING THE CONTAINER

FIELD OF THE INVENTION

The present invention relates to a container used for transporting, for instance, molten aluminum and for supplying thereof to a use-point and a method of manufacturing the container.

BACKGROUND OF THE INVENTION

In a factory where aluminum is molded using many die-casting machines, an aluminum material is often supplied, not only from within the factory but also from outside of the factory. In such a case, a container storing aluminum in a melt is carried from a factory on the material supply side to a factory on the molding side to supply to each of the die-casting machines the material kept in the melt. For example, published utility model application 1: JP-U-03-31063 (FIG. 1).

The inventors of the present inventions have proposed a technique in which by making use of pressure difference a material is supplied from such container to the die cast machine side. In other words, according to the technology, the inside of the container is pressurized and a molten metal material disposed in the container is discharged outside through a pipe introduced in the container.

Since a container of this kind is necessary to be heat insulating and fire-resistant, the container is provided with a lining inside of a frame made of, for instance, an iron. Inventors of the present invention have developed a technique in which in such a container a flow path for externally supplying a molten metal in the container is buried in a lining and thereby the heat-retention property of the molten metal that flows the flow path is improved. When the heat-retention property of the molten metal in the flow path is improved, there is an effect in that the molten metal is inhibited from solidifying in the flow path therefore clogging of the flow path is prevented.

However, there is a problem in that the lining inside of the container cracks caused by the thermal expansion and the mechanical impact, when the cracking reaches from a space inside the container to the flow path, a gas for applying pressure directly flows through the cracking portion into the flow path, causing an unstable supply. Furthermore, there is also a problem in that the molten metal in a state of containing the gas therein is blown out of the pipe and molten metal with high temperature is splattered in a surrounding area.

A configuration in which a stoke being hanged down to a storing portion of a molten metal from a top surface portion of the container and the stoke being used as a flow path of the molten metal can be considered. However, this kind of a container requires heating (pre-heating) prior to the use thereof and thereby a large thermal load is applied to the stoke during the heating. For this reason, there is a problem in durability, for example, the stoke being cracked easily. Furthermore, when a metal stoke is used to avoid the cracking, the metal is exposed to a high temperature atmosphere created by the heating, as a result, there is another problem in that a hole is easily formed owing to the oxidation.

The present invention was achieved to overcome such problems and intends to provide a container in which a gas for applying pressure does not leak to the flow path that cause a molten metal flow between inside and outside of the container and a method of manufacturing the container.

DISCLOSURE OF THE INVENTION

In order to overcome such problem, a main aspect of the present invention is a container comprised of a frame, a lining that is provided inside the frame, having a flow path for causing the molten metal flow from the inside to the outside of the container and a pipe disposed to surround at least a part of the flow path.

Another aspect of the present invention is a container capable of storing a molten metal comprises a frame and a lining, having a flow path for flowing the molten metal therein; the flow path being provided an inside of the frame and at least a part thereof is surrounded by a member restricting a flow of a gas. As a restriction member of this kind, materials such as metals (including an alloy) and ceramics can be cited. Furthermore, the restriction member is preferably constituted of a layer thermodynamically uniform from a macroscopic point of view. This is because in the case of a mixture (such as caster) being made of a plurality of materials different in the physical properties, in other words, in the case of a mixture being made of a layer thermodynamically non-uniform from a macroscopic point of view, cracking and the like are likely to occur caused by periodically applied thermal load, difference of the thermal expansion coefficients and so on, and thereby a gas is allowed to flow in. A constitutional material of the pipe has only to have the uniformity to the extent of a metal alloy and a commercially available ceramics sintered product.

According to the present invention, the pipe is preferably made of a metal and a layer of a lining comprised of a refractory member is preferably formed inside of the pipe. When such a lining layer is disposed, a metallic part can be prevented from deteriorating caused by the heat. Furthermore, rapid deterioration of the pipe can be prevented as it being made of a metal. In other words, when the pipe is made of a metal, even when the pipe is deteriorated caused by the heat or impact, longer time period is necessary until inconvenience occurs. Accordingly, for instance, when the pipe is sufficiently maintained, the pipe and the like can be replaced before such inconvenience occurs to an extent that can be estimated.

When a lining layer made of such a refractory member is formed, on an inner surface of the pipe, a holding member for holding the refractory member is preferably disposed in a protruding manner. Thereby, the refractory member can be inhibited from falling off the pipe.

Furthermore, such a holding member is preferably disposed at a lower side of the pipe. For example, even when the crack is formed in the middle of the lining layer, the lining layer does not fall off since the lining layer is supported at a lower side of the pipe.

Still furthermore, in such case, an inhibition region where a holding member is inhibited from being disposed is preferably disposed on an upper side of the pipe and inside thereof. In other words, a holding member is not preferably disposed in this region. Owing to difference in the thermal expansion coefficients between the pipe and the lining layer, expansion of the pipe and the lining layer become different when the pipe is heated. Accordingly, as both of the upper and the lower side of the pipe are held with the holding member, when stress is imposed onto the both, cracking or deformation may occur. Therefore, the elongation is absorbed and thereby the stress is prevented from being generated by disposing a prevention region as in the present invention.

As a pipe used in the present invention, a ceramics pipe or a metal pipe inside of which is lined with a refractory member is preferred. As the metal, for instance, SGP, STPT (carbon steel tube for high temperature pipe) or STPG (carbon steel tube for pressure pipe) can be used.

As the refractory member, for instance, refractory members (including fire resistant caster, heat insulator, and heat-insulating caster) for molten aluminum, molten magnesium and so on can be used. These refractory members may be mixed with ceramics, carbon or graphite. Thereby, the non-wettability of the molten metal to the pipe can be improved and also the strength can be improved. Furthermore, the maintenance also becomes easier. More specifically, as the refractory members, trade name TMU 85AEFN ($Al_2O_3$: 82 percent, $SiO_2$: 13 percent) and SC SAE85 ($Al_2O_3$: 8 percent, SiC: 83 percent, $SiO_2$: 7 percent) both manufactured by NIPPON TOKUSHUROZAI KK can be cited. However, the present invention is not restricted to such materials.

In the present invention, since the flow path is provided inside the lining, the thermal conduction from the molten metal storing portion to the flow path is high. Accordingly, since the heat-retention property of the molten metal that flows the flow path can be improved and the fluidity can be maintained, the clogging of the flow path can be eliminated. In addition, since the flow path is surrounded with a member that restricts the flow of a gas such as a metallic pipe or a ceramics pipe, a gas for applying pressure does not leak to the flow path. Accordingly, the molten metal can be stably supplied. Furthermore, the ceramics layer is effective for the heat-retention of the flow path since the ceramics layer is high in thermal conductivity. As ceramics, $Si_3N_4$, SiN, SiC, $TiO_2$, TiN and carbon can be cited. More specifically, as the ceramic pipe, trade name SCN (SiC: 74.8 percent, $Si_3N_4$: 23.54 percent) manufactured by TYK Corp, trade name KN 101 (mainly made of $Si_3N_4$) manufactured by Kubota Corp., trade name SN 220 (mainly made of $Si_3N_4$) manufactured by Kyocera Corporation, and trade name Sialon HCN 10 (mainly made of $Si_3N_4$) manufactured by Hitachi Metals Ltd. can be cited. These are molded by means of, for instance, a CIP (Cold Isostatic Press) method. In such a case, pressure at this time is preferably 10000 kgf/cm$^2$ or more. In general, the ceramics pipe has high degree of mechanical strength but cracking is likely to occur owing to the thermal load. However, in the present invention, since the ceramic pipe is buried in the lining layer, the outside of the pipe is not directly exposed to a high temperature during preheating of the container, therefore, the lifetime thereof is very long. Furthermore, even when the pipe cracks, as far as the flow path is maintained, the supply of the molten metal can be continued. Accordingly, a situation where the molten metal becomes suddenly incapable of being supplied at the user side and the container has to be carried back can be avoided.

Here, from the viewpoint of the heat-retention property of the flow path, the flow path preferably is provided inside the lining from a position close to a bottom portion inside the container to a top surface side of the container. As an example of arrangement of the flow path, the lining is formed such that to extend to an upper direction and to a lower direction and to have a protruding portion protruding to an inner wall side of the container, and the flow path is formed inside the protruding portion along with the direction that the protruding portion extends.

In addition, when the flow path is structured so that it being surrounded by a pipe buried in the lining, and when the pipe is made into a cartridge, the flow path becomes replaceable once it is clogged. The pipe may be disposed so as to surround not the whole of the flow path but a part thereof. When the pipe is disposed to a part of the lower portion of the flow path, in some cases, the replacing of the pipe involves difficulty.

When a structure where an inner surface of the pipe is covered with a refractory member, the durability of the pipe can be improved and the gas for applying pressure can be prevented from leaking into the flow path for a long time period. Furthermore, the protruding portion in the vicinity of a lower opening of the pipe preferably has a tapered shape so that the inside of the container may be wider. Thereby, during the maintenance of the container, the accessibility from the inside of the container toward the lower portion of the pipe can be improved. This configuration, together with a detachable structure of the large lid, improves the maintenance properties of the container and the reliability of the container.

A method of manufacturing a container according to the present invention having a frame, a lining disposed inside the frame having a flow path for causing the molten metal flow therein and a pipe disposed to surround at least a part of the flow path comprises, disposing the pipe into a hole for forming the flow path, pouring a liquidized pipe holding member into a gap formed between the pipe and the hole and solidifying the pipe holding member. At this time, the pipe holding member is preferably poured as holding the pipe so that the pipe does not contact the lining.

According to the present invention, it is preferable that the liquidized pipe holding member has a characteristic such that its strength becomes lower than that of the lining after being solidified. For example, ceramic fiber and the like can be cited as the pipe holding member. The hardening may be performed as heating the container. Furthermore, a material having the density smaller than that of the lining may be used. As such member, a material in which ceramic fiber is dispersed in a binder can be cited, however, other materials can be used as well.

Another aspect of the present invention is a container capable of storing a molten metal comprises, a frame, a lining, provided inside the frame, having a flow path for causing the molten metal flow from the inside to the outside of the container and a pipe disposed to surround at least a part of the flow path and a pipe holding layer disposed between a hole for forming the flow path and the pipe, and having a strength or density lower than that of the lining. The pipe holding layer also functions as a release layer of the stress caused by the thermal deformation and the like of the pipe.

In the present invention, the structure where the pipe is buried in the lining through a member lower in the mechanical strength (or lower in the density) than the lining enables the pipe to be replaced and to be easily formed into a cartridge. When a pipe is replaced, a member that is lower in the mechanical strength or density than the lining or a member that is more brittle than the lining is destroyed and the pipe is taken out of the lining followed by removing the pipe holding member inside of the hole. Thereafter, a pipe is disposed inside of the lining then a member that is lower in the mechanical strength or density than the lining or a member that is more brittle than the lining once it being hardened is poured into a gap to fix the pipe inside the lining. Accordingly, the pipe becomes replaceable. Having a pipe being replaceable independently from the lining, the cost necessary for maintaining the container is largely reduced.

Another aspect of the present invention is a container capable of holding a molten metal comprises, a frame, a lining, provided inside the frame, having a hole penetrating from an opening located at the bottom to an upper surface portion of the container, a first pipe forming the flow path when being inserted into the hole that has a first flange disposed at the upper surface portion side of the container, a hook for holding the first pipe protruding from an inner wall of the frame and a pipe holding layer disposed between the hole and the first pipe. The hook may be formed of various kinds of steel materials such as a round bar. A member having the heat insulating property such as a ceramics sheet is preferably disposed between the hook and the first pipe to improve the heat insulating property.

Another aspect of the present invention is a container capable of holding a molten metal comprises, a frame, a lining, provided inside the frame, having a hole penetrating from an opening located at the bottom to an upper surface portion of the container, a first pipe forming the flow path when being inserted into the hole; the flow path is for causing the molten metal flow inside and outside of the container, and a pipe holding layer disposed between the pipe and the hole, so that the first pipe does not come into contact with the frame.

According to the present invention, the first pipe that becomes a flow path of the molten metal is disposed thermally isolated from the frame, therefore, heat does not diffuse from the first pipe. Accordingly, the first pipe becomes difficult to be clogged. In particular, an upper portion of the first pipe and a portion close to the outside of the frame is likely to be affected by heat release and the temperature is likely to decrease. Accordingly, the molten metal becomes bad in the fluidity and likely to cause clogging. In the present invention, a structure in which the first pipe is disposed thermally separated as far as possible from a flange receiver, a second flange and the frame, therefore, influence of the heat release can be suppressed to the lowest level. As a result, the fluidity of the molten metal can be maintained and thereby the clogging of the pipe can be prevented from occurring. An upper portion of the first pipe is preferably disposed in a direction as vertical as possible. Normally, a liquid level of the stored molten metal is existent at an upper portion of the container. When the container is wobbled during transportation, the molten metal in the first pipe is wobbled as well. Furthermore, when the pipe is obliquely disposed, when it is wobbled, the molten metal is likely to reach to a larger area and to be cooled. For this reason, as in the present invention, when a portion upper than the vicinity of the liquid level of the molten metal in the first pipe is vertically provided, such cooling can be suppressed to the minimum level and thereby the clogging of the pipe can be prevented from occurring.

According to the present invention, at the upper surface portion of the container, it is preferable to have, a flange receiving portion surrounding the first flange portion and provided so that to have the surface portion at a higher location than that of the first flange portion, a second pipe having a second flange fixed to the flange receiving portion, communicating with the flow path, a first packing, having a first thickness, being inserted between the surface of the first flange and the surface of the second flange and a second packing, having a second thickness thinner than the first thickness, being inserted between the surface of the flange receiving portion and the surface of the second flange. The flange receiver may have whatever shape as far as the second flange can be fastened. For example, a flange similar to the second flange may be fastened on the frame. Here, a position that is higher than a height of a surface of the first flange means that a surface of the flange receiver and a flange surface of the first flange are separated with a predetermined distance inserted therebetween. Between the first flange of the first pipe and the second flange, the first packing is inserted and between the first flange and the second flange the second packing is inserted. Accordingly, as mentioned above, the first packing on an inner periphery side becomes thicker than the second packing on the outer periphery side.

According to another aspect of the present invention, the container capable of storing a molten metal comprises, a frame, a lining, provided inside the frame, having a hole penetrating from an opening located at the bottom to an upper surface portion of the container, a first pipe forming the flow path for causing the molten metal flow from the inside and the outside when being inserted into the hole, having a first flange disposed at the upper surface portion side of the container, a flange receiving portion surrounding the first flange portion and provided so that to have the surface portion at a higher location than that of the first flange portion, a second pipe, having a second flange fixed to the flange receiving portion, communicating with the flow path, a first packing, having a first thickness, being inserted between the surface of the first flange and the surface of the second flange and a second packing, having a second thickness thinner than the first thickness, being inserted between the surface of the flange receiving portion and the surface of the second flange.

According to the present invention, since the first packing is thicker than the second packing, the first pipe held therethrough has some mechanical allowance. Accordingly, due to shaking and the like, the first pipe, in particular, the first flange becomes difficult to be deformed and, as a result, cracking can be prevented from occurring. Simultaneously, the stress caused by periodically applied heat can be alleviated by the allowance, resulting in prevention of cracking and the like. In addition, since the first flange in the first pipe is also thermally separated from the frame, heat from the first pipe does not diffuse. Accordingly, the first pipe becomes difficult to be clogged.

More preferably, the present invention includes a heat insulating member that is inserted between a rear surface of the first flange and the hook. Thereby, the first flange in the first pipe is thermally more separated from the frame therefore the clogging of the first pipe is more unlikely to occur.

According to another aspect of the present invention, a container capable of storing a molten metal and supplying the molten metal to an outside using a pressure difference between an inside and an outside of the container, comprises, a frame having a first flange at an opening portion and a lining having a flow path for causing the molten metal flow therein with the opening portion opening close to the center of the container, a second pipe having a second flange being connected to the first flange so that the second pipe is connected to the flow path at the opening and a first pipe surrounding at least a part of the flow path and disposed so that an end surface thereof locates at a lower position than an opening of the opening surface of the frame.

When an inner diameter of the first flange is made larger than an outer diameter of the first pipe, between the flow path of the molten metal and the first pipe, it is possible to retain a space in which an insulating layer can be filled. In addition, it is preferable that the first pipe is disposed without touching the flange receiving portion and the second flange directly. This is because when the first pipe is in direct contact with the first flange or the second flange, a temperature of the first pipe is likely to decrease due to the radiational cooling.

In addition, the filling of a member to be a pipe holding member can be carried out in such a manner that a port is disposed in the vicinity of a lower side of the first flange of the frame and pouring the member therefrom. The port is preferably provided at least two, one of the two ports is to fill in a pipe holding member, and the other is to evacuate an air therefrom. Accordingly, the filling can be improved in quality. Furthermore, the completion of the filling can be also observed therefrom.

According to another object of the present invention, a container capable of storing a molten metal and supplying the molten metal to an outside using a pressure difference between an inside and an outside of the container comprises a frame, a lining layer provided inside the frame, having a flow path from a lower direction to upper direction therein, and a pipe replaceably disposed in the flow path of the lining layer. The replaceability of the pipe can be achieved further by disposing a pipe holding layer having the smaller mechanical strength or density (or larger brittleness) than that of the pipe between the pipe inserted in the flow path and the lining layer. The pipe holding layer also functions as a release layer of the stress caused by the thermal deformation and the like of the pipe.

In other words, in the present invention, in order to prevent a gas from intruding (high-pressure gas is likely to intrude) into a flow path of a molten metal caused by a crack and the like formed in the lining (such as molten aluminum alloy and molten magnesium alloy) in the frame, a rigid pipe is adopted and a replaceable cartridge structure is adopted as a fastening method of the pipe. When the molten metal is to be supplied using the pressure difference, there is a problem in that the pipe is likely to be clogged. In the present invention, in order to positively supply an amount of heat from a molten metal storing portion in the container to the flow path side, in some cases, the protruding portion is disposed inside of the lining and a hole that becomes a flow path like a tunnel is disposed inside of the protruding portion. However, in such a structure, due to the cracking of the caster, a gas is likely to intrude into the flow path. In this connection, according to the present invention, in order to prevent the gas from intruding into the flow path of the molten metal in the frame, a rigid pipe is adopted, and furthermore a replaceable cartridge structure is adopted as a fastening method of the pipe.

When the pipe is not formed into a cartridge structure, almost all of the lining of the container has to be reinstalled every time when the pipe is replaced, resulting in very high cost. However, when the pipe is formed into a cartridge structure like the present invention, only the pipe can simply and cheaply be replaced.

Furthermore, since the pipe holding layer is smaller in the rigidity and the strength than the caster of the lining of the frame and the pipe, the pipe holding layer functions also as a release layer of the stress caused owing to the thermal deformation of the pipe. In order to improve this function, the pipe holding layer may be at least partially impregnated with aluminum or a mixture of aluminum and aluminum oxide. The mixture of aluminum and aluminum oxide is not necessarily large in the rigidity but strong in the tenacity and very large in the mechanical strength. Furthermore, it has the following property to the deformation. Accordingly, when it is impregnated in the pipe holding layer, the stress relieving capability can be improved.

Another aspect of the present invention is a container capable of holding a molten metal comprises, a frame, a lining, provided inside the frame, having a protruding portion to protrude inside of the container so that the protruding portion extends to an upper direction and to a lower direction, a flow path for having the molten metal flow from an inside and to an outside of the container provided inside the protruding portion and an opening portion located close to the bottom surface of an inner side of the container that communicates with the flow path, a pipe being inserted into the flow path, and a holding portion holding a lower end surface of the pipe in order to maintain a gap created between the bottom of the container and a lower end surface of the pipe.

In the present invention, since a holding member for holding the pipe is disposed, the pipe and the lining layer that may be formed inside of the pipe can be prevented from falling off. In addition, in the manufacturing process of the container, there is an effect in that when the pipe is inserted in the flow path and fixed, a jig for fixing a position becomes unnecessary.

The holding member is preferably disposed integrally with the lining. For example, when the holding member is constituted of a stepped portion projected toward the flow path from the lining disposed at a lower portion of the flow path, the integration can be realized with a simple configuration.

Another aspect of the present invention is a container capable of storing a molten metal comprises a frame, a lining provided inside the frame, and a pipe for causing the molten metal flow therein is disposed so that the pipe touches the lining along with a direction of the flow of the molten metal.

The pipe may be the above-mentioned metallic pipe or a ceramics pipe.

The preheating the inside of the pipe, generally, is performed as opening a hatch disposed approximately at the center of a top surface of the container and a gas burner being inserted therefrom. In the present invention, since the pipe contacts with the lining and located at a position farthest from the center of the container, the pipe is positioned at the farthest position from the gas burner in the container. Accordingly, the pipe of the present invention is unlikely to be thermally affected from the gas burner. In addition, heat radiated from the gas burner to the pipe is conducted to the lining side that is in contact with the pipe, and thereby the pipe is prevented from being partially overheated. For this reason, according to the present invention, the deterioration of the pipe caused by the preheating operation can be minimized.

A container involving the present invention is transported through a public road mounted on, for example, a truck. Accordingly, the container is exposed to a vibration of a substantial magnitude. According to the present invention, since the pipe is in contact with the lining, the pipe can be prevented from being mechanically destroyed due to the vibration of the pipe.

Furthermore, the container of the present invention, after the molten metal is discharged from the container, the molten metal remains to some extent in the container (residual molten metal). Such residual molten metal is removed from the container from the pipe by tilting the container. In the present invention, since the pipe contacts with the lining and located at a position farthest from the center of the container, change in a surface level of the residual molten metal when the container is tilted is the largest. Therefore, with the minimum tilting, the residual molten metal can be effectively removed.

It is preferable that the lining has a dent along with a direction of the flow of the molten metal in the pipe, and a part of the pipe is buried into the dent. Thereby, the pipe can be firmly grasped. In addition, since an area through which the pipe and the lining come into contact can be made larger, the thermal conductivity from the pipe to the lining can be increased.

In addition, it is preferable in the present invention that an inner periphery of the lining is made into a cylindrical shape and a circumference of the dent is formed a planar.

Another aspect of the present invention is a container capable of storing a molten metal comprises, a container body having a first opening portion at an upper portion thereof, a pipe being extended from the container body to an outside through the first opening for causing the molten metal flow therein, and a lid, having a passage for inserting the pipe there through, provided to cover the first opening portion and detachably disposed to the container so that the lid is capable of being detached from the container while the pipe is being held onto the container.

In a container that reserves a molten metal such as molten aluminum, in particular, around the corners of the container, slag (oxide of aluminum) adheres therefore maintenance operation for removing the slag is necessary. In this case, for example, the lid disposed to the upper opening portion of the container body has to be taken off. In the container of the present invention, the pipe penetrates inside and outside of the container through a passage provided on the lid and the lid can be taken off from the container body while the pipe being disposed in the container body. Accordingly, since the lid can be taken off with the pipe remaining on the container body side, the maintenance operation can be facilitated.

The preferable embodiment of the present invention is to have a frame and a lining disposed inside of the frame and the pipe is to be disposed so as to come into contact with the frame.

In addition, it is also preferable that the container body is comprised of a frame, a lining, provided inside the frame, having a protruding portion to protrude to the inside of the container so that the protruding portion extends to an upper direction and to a lower direction and a flow path for having a molten metal flow from an inside and to an outside of the container provided inside the protruding portion and a second opening portion close to the bottom surface of an inner side of the container that communicates with the flow path, and the pipe is inserted into the flow path.

In such case, the pipe is more preferably exposed toward an inner surface of the container at the second opening. Heat from the molten metal is conducted from an exposed portion of the pipe to the whole the pipe and thereby the molten metal that flows inside the pipe can be prevented from clogging.

BEST MODE FOR CARRYING OUT THE INVENTION

Hereinafter, embodiments of the present invention will be described in details with reference to the drawings.

Figure 1:
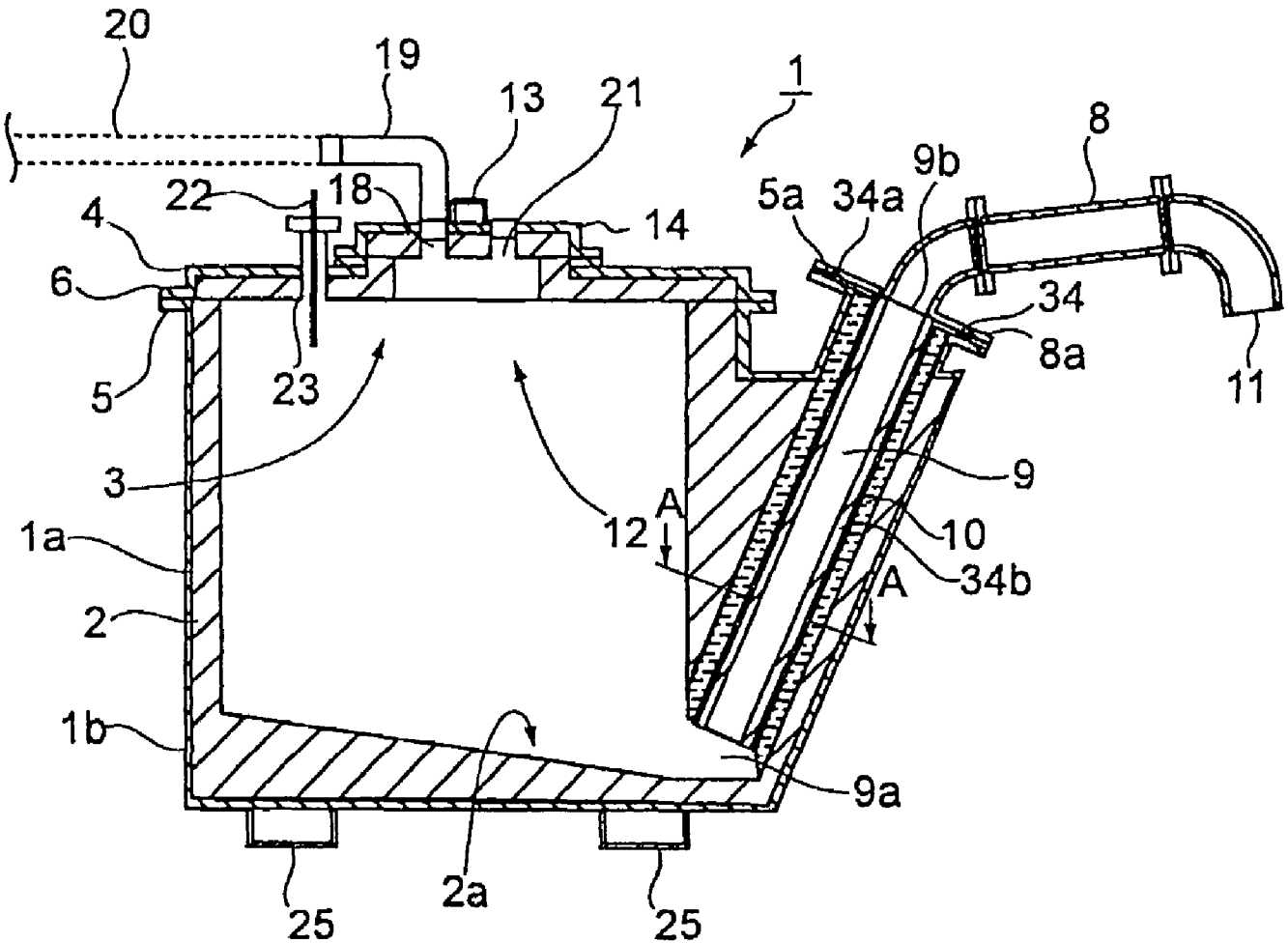
FIG. 1 is a cross-sectional view of the container according to an embodiment of the present invention.
Figure 2:
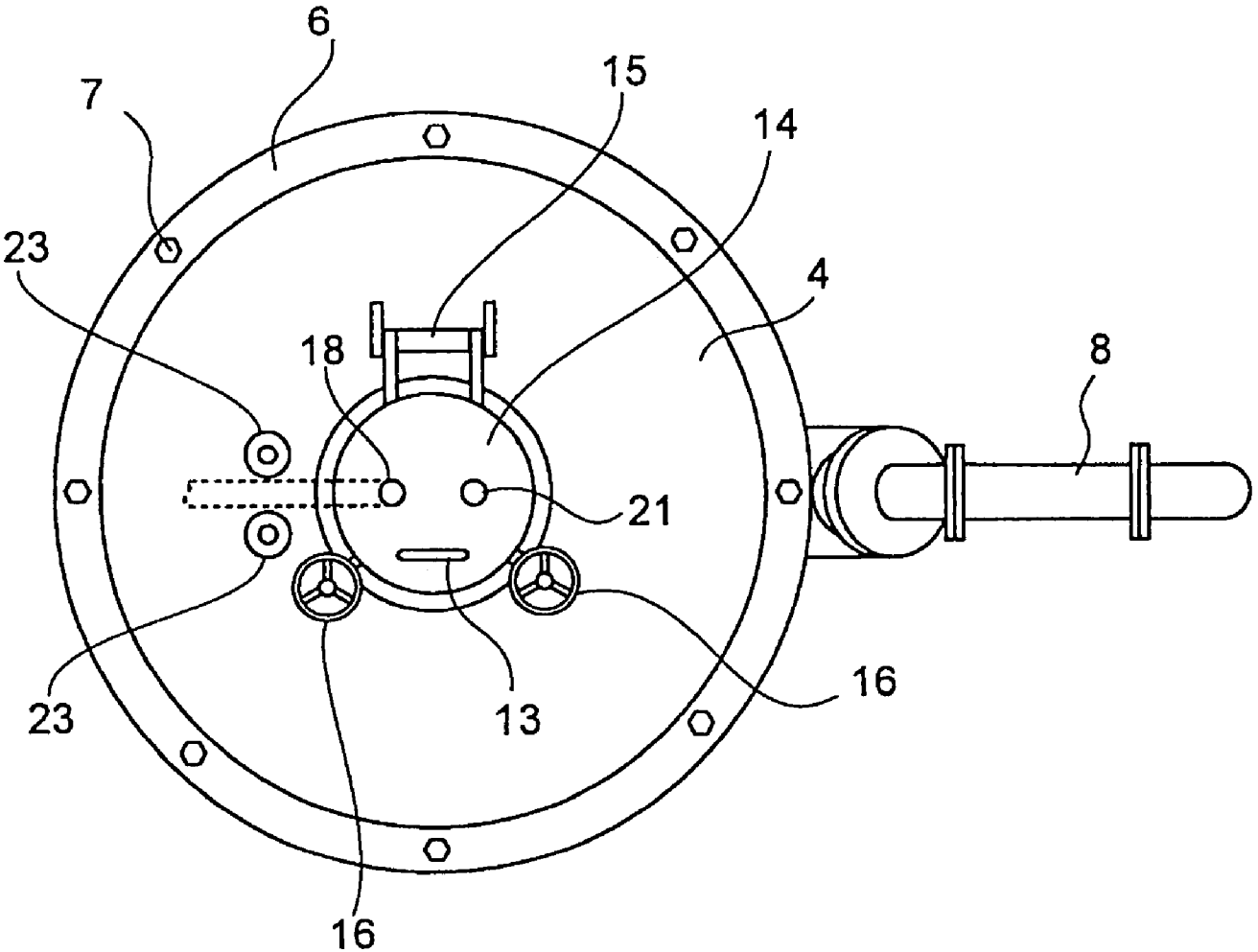
FIG. 2 is a plane view of FIG. 1.

FIG. 1 is a cross-sectional view of the container according to an embodiment of the present invention. FIG. 2 is a plan view of FIG. 1.

A container 1 has a structure in which a lining 1*b* is formed inside of a frame 1*a* and a flow path 9 for flowing a molten metal between the inside and the outside of the container 1 is buried in the lining 1*b*. The lining 1*b* is made of a plurality of layers, the innermost layer thereof being made of a fire resistant caster, an outer layer side thereof being made of a heat insulating caster, a heat insulating board or a heat insulating sheet. The container 1 is configured such that a large lid 4 is provided at an upper opening 3 of a bottomed cylindrical body 2. Flanges 5 and 6 are provided at outer peripheries of the body 2 and the large lid 3 respectively, so that the flanges are fastened together with bolts 7 to fix the large lid 3 to the body 2.

At approximately the center of the aforementioned large lid 4, an opening 12 is provided, and a hatch (a small lid) 14 with a handle 13 attached thereto is disposed at the opening 12. The hatch 14 is provided at a position slightly higher than the upper face of the large lid 4. A portion on the outer periphery of the hatch 14 is attached to the large lid 4 through a hinge 15. This allows the hatch 14 to freely open and close the opening 12 in the large lid 4. In addition, bolts with handles 15 for fixing the hatch 14 to the large lid 4 are attached to two points of the outer periphery of the hatch 16 in a manner opposite to the position to which the hinge 15 is attached. By closing the opening 12 in the large lid 4 with the hatch 14 and rotating the bolts with handles 16, the hatch 14 is fixed to the large lid 4. On the other hand, by inversely rotating the bolts with handles 16 to release the fixation, the hatch 14 can be opened from the opening 12 in the large lid 4. Then, with the hatch 14 being opened, maintenance of the inside of the container 1 and insertion of a gas burner at the time of preheating can be performed through the opening 12.

Further, a passage 18 for internal pressure adjustment for reducing and applying the pressure in the container 1 is provided at a center or a position slightly off from the center of the hatch 14. To the passage 18, a pipe 19 for applying and reducing the pressure is connected. The pipe 19 extends upward from the passage 18, bends at a predetermined height, and extends in the horizontal direction. The surface of a portion of the pipe 19 inserted into the passage 18 is threaded, and on the other hand, the passage 18 is also threaded. This firmly screws the pipe 19 to the passage 18. Furthermore, a plug may be buried in a passage 18 and may be fastened to one end of the pipe 19 with a quick coupler structure that becomes a socket to the plug.

To one end of the pipe 19, a pipe 20 for applying the pressure or reducing the pressure can be connected. A tank storing a compressed gas and a pump for applying the pressure are connected to the pipe for applying the pressure, and a pump for reducing the pressure is connected to the pipe for reducing the pressure. Then, it is possible to introduce the molten aluminum of a temperature in a range of 650 degrees Celsius and 730 degrees Celsius into the container 1 through the pipe 8 and the flow path 9 using a pressure difference resulting from applying the pressure, and it is possible to discharge the molten aluminum to the outside of the container 1 through the flow path 9 and the pipe 8 using a pressure difference resulting from applying the pressure. It should be noted that use of an inert gas, for example, nitrogen gas as the compressed gas makes it possible to prevent more effectively oxidation of the molten aluminum during the pressurization.

At a position slightly off from the center of the hatch 14 and opposite to the above-mentioned passage 18 for applying and reducing the pressure, a passage 21 for releasing pressure is provided, and a relief valve (not shown) can be attached to the passage 21 for releasing pressure. Thereby, for example, when the inside of the container 1 reaches a predetermined pressure or higher, the inside of the container 1 is released to the atmospheric pressure in viewpoint of safety. The relief valve may be disposed on a applying/reducing pressure controlling system side located opposite to a hose 20. Thereby, it becomes unnecessary to independently provide a relief valve to each container.

In the large lid 4, two passages 23 for level sensors are disposed with a predetermined distance therebetween into which two electrodes 22 are inserted respectively as the level sensors. The electrodes 22 are inserted into the through holes 23 respectively. The electrodes 22 are disposed opposite to each other in the container 1, and their tips extend, for example, to positions at a level approximately the same as that of a maximum liquid surface of the molten metal in the container 1. It is thus possible to detect the maximum level of the molten metal in the container 1 by monitoring the conduction state between the electrodes 22, thereby enabling prevention of excessive supply of the molten metal to the container 1 with more reliability.

On the rear face of the bottom portion of the body 2, two channels 25 having a cross section in a square shape into which, for example, a fork of the fork lift truck (not shown) is inserted and a having predetermined length, are disposed, for example, in parallel to each other. Further, the entire bottom portion inside the body 2 is inclined to be low on the flow path. This reduces so-called remained melt when the molten aluminum is discharged to the outside through the flow path 9 and the pipe 8 by compression. In addition, when the container 1 is tilted, for example, at the time of maintenance to discharge the molten aluminum to the outside through the flow path 9 and the pipe 8, the angle of tilting the container 1 can be decreased, providing improved safety and workability.

Here, the flow path 9 is surrounded with a pipe 34 made of a metal such as iron. An inner wall of the pipe 34 is covered with a refractory material 34*b*. Thereby, the heat-resisting property of the pipe 34 is improved. Furthermore, the pipe 34 is buried through a filling material 10 in the lining 1*b*. The filling material 10 has smaller strength than the lining 1*b*. The strength here mainly means the bending strength against external mechanical stress, and materials smaller in the density than the lining can be cited. As the lining 1*b*, for instance, dense refractory ceramic materials can be cited. As the filling material 10 that is lower in the strength than the lining 1*b*, for example, one that is made of ceramic fiber and a binder (such as alumina:silica=2:8) can be cited, at this time the bulk density is substantially 1.2, and more specifically Joint Sealer-13 (manufactured by Toshiba Monofrax Co., Ltd.) and Fiber Excel (trade name) can be cited.

The flow path 9 surrounded by the pipe 34 extends toward an upper portion 9*b* on the outer periphery of the body 2, through an opening 9*a* provided at a position of the inner periphery close to a bottom portion 2*a* of the container body.

To the upper portion 9*b* of the flow path 9, for example, the pipe 8 is fastened using, for instance, a bolt and thereby detachably connected. The pipe 8 is, for example, made of an iron and has, for instance, a R shape. This structure allows the molten metal to flow more smoothly. The flow path 9 and the pipe 8 linking thereto are preferably approximately the same in inner diameter, about 65 mm to about 85 mm. Conventionally, the inner diameters of those types of pipes are approximately 50 mm.

This is because it was thought that when the inner diameters of those pipes exceed 50 mm, a large pressure is required to apply pressure to the inside of the container and discharge molten metal from them. In contrast, the inventors and the like of the present invention concludes that the inner diameter of the flow path 9 and the pipe 8 that follows the flow path is preferable to be of much larger than 50 mm, namely, 65 mm to 85 mm, more preferable to be 70 mm to 80 mm, and even more preferable to be 70 mm. In other words, it is thought that when molten metal flows upward in the flow passage and the pipe, two parameters, the weight of the molten metal itself in the flow passage and the pipe and the viscous drag of the inner walls of the flow passage and the pipe largely affect the resistance that obstructs the flow of the molten metal.

Although an inner diameter of a pipe can be designated irrespective of the standards, commercially available pipes according to Japan Industrial Standard (JIS standard) are 80A, 100A and 125A. The pipes conforming to the JIS standard are advantageous from point of view of the cost and the delivery time as well. From a viewpoint of weight, the pipe 125A is heavy and inadequate. Furthermore, in the case of the pipe 100A, an inner diameter is limited to substantially 70 mm to 80 mm (a limit from the manufacturing point of view and a limit to a thickness of a lining that is needed at least). Considering the above and the physical operational effects, the availability in the market and the competitiveness, inventors decided to set the inner diameter to be substantially 70 mm to 80 mm. When the inner diameters are smaller than 65 mm, molten metal that flow in the pipe is affected by the weight of the molten metal and the viscous drag of the inner walls at any positions. However, when the inner diameters exceed 65 mm, an area that is not affected by the viscous drag of the inner walls starts to form nearly at the center of the flow and becomes larger and larger. The area has a large influence and, as a result, the resistance that obstructs the flow of the molten metal starts to fall. Thus, it becomes that only a very small pressure is needed to discharge the molten metal from the container. In other words, conventionally, the influence of such an area was not considered at all, and only the weight of the molten metal is considered as a cause of varying resistance that obstructs the flow of the molten metal. Due to the operability, maintenability, and so forth, the inner diameters was designated approximately 50 mm. On the other hand, when the inner diameters exceed 85 mm, the weight of the molten metal becomes dominant as a resistance that obstructs the flow of the molten metal. As a result, the resistance that obstructs the flow of the molten metal becomes large. According to the prototype produced by the inventors of the present invention and the like, when inside diameter being 70 mm to 80 mm, a very small pressure is sufficient to be applied to inside the container. Especially, inside diameter being 70 mm is most preferable, from the view point of both the standardization and the operability. This is because the diameter of a pipe is standardized by 10 mm, namely, 50 mm, 60 mm, 70 mm etc and smaller the diameter, the easier to handle and the better the operability.

At an upper end portion of the pipe 34 a first flange 34*a* is disposed, and to the frame 1*a* a second flange 5*a* that is in contact with a lower surface of the first flange 34*a* is disposed so as to surround a periphery of the pipe 34. Here, an outer diameter of the first flange 34*a* is set smaller than that of the second flange 5*a*. Thereby, heat radiated from the pipe 34 can be made smaller and the heat-retention effect of the flow path 9 can be improved. The flange 8*a* of the pipe 8 is fastened to the container 1 side through a bolt omitted from showing in the drawing. Between the flanges, a heat insulating packing is inserted.

Figure 3:
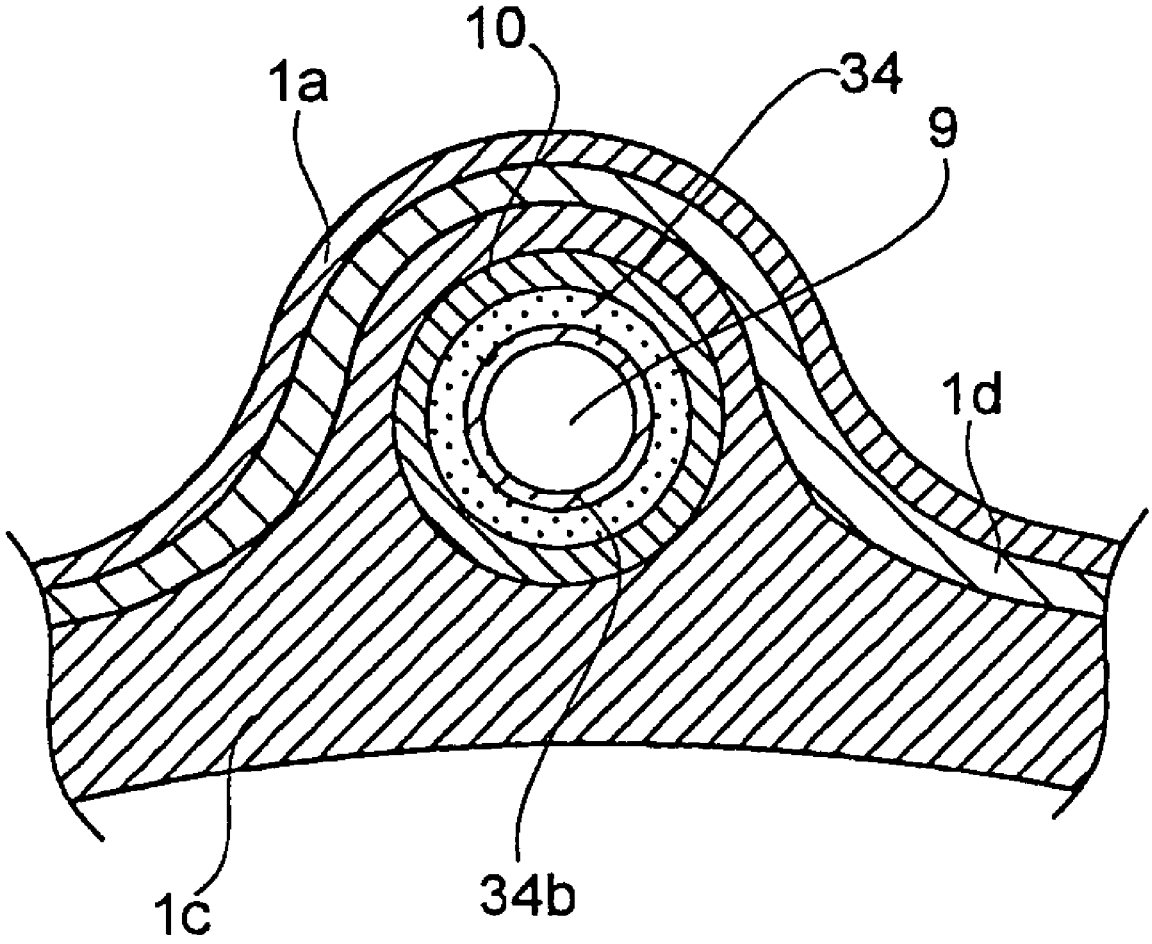
FIG. 3 is a cross-sectional view of a part in FIG. 1.

FIG. 3 is a cross sectional view of FIG. 1 cut at A-A line.

As shown in FIG. 3, the lining 1*b* is formed in a two-layered structure of the refractory layer 1*c* and the heat insulating layer 1*d*. The flow path 9 is disposed inside of the refractory layer 1*c*. The adoption of such configuration enables the released heat to be transmitted to the flow passage 9. On the other hand, an approximately half of the flow path 9 is covered with the heat insulating layer 1*d* and thereby the heat-retention effect is increased. As a refractory layer 1*c* a refractory type ceramics material can be named as an example. In addition, as the heat insulating layer 1*d*, a ceramics material having lower density than the refractory member can be used.

In the present embodiment, since the flow path 9 is surrounded with the pipe 34, even when the lining 1*b* cracks, a gas does not reach from inside of the container 1 to the flow path 9, therefore, a gas is not mixed with the molten aluminum discharged from the pipe 8. Furthermore, even when the flow path 9 clogs, the clogging can be removed merely by replacing the pipe 34. Still furthermore, the pipe can be easily replaced when damaged.

Hereinafter, embodiments of the present invention will be described with reference to the FIG. 4 FIG. 5 and FIG. 6.

Figure 4:
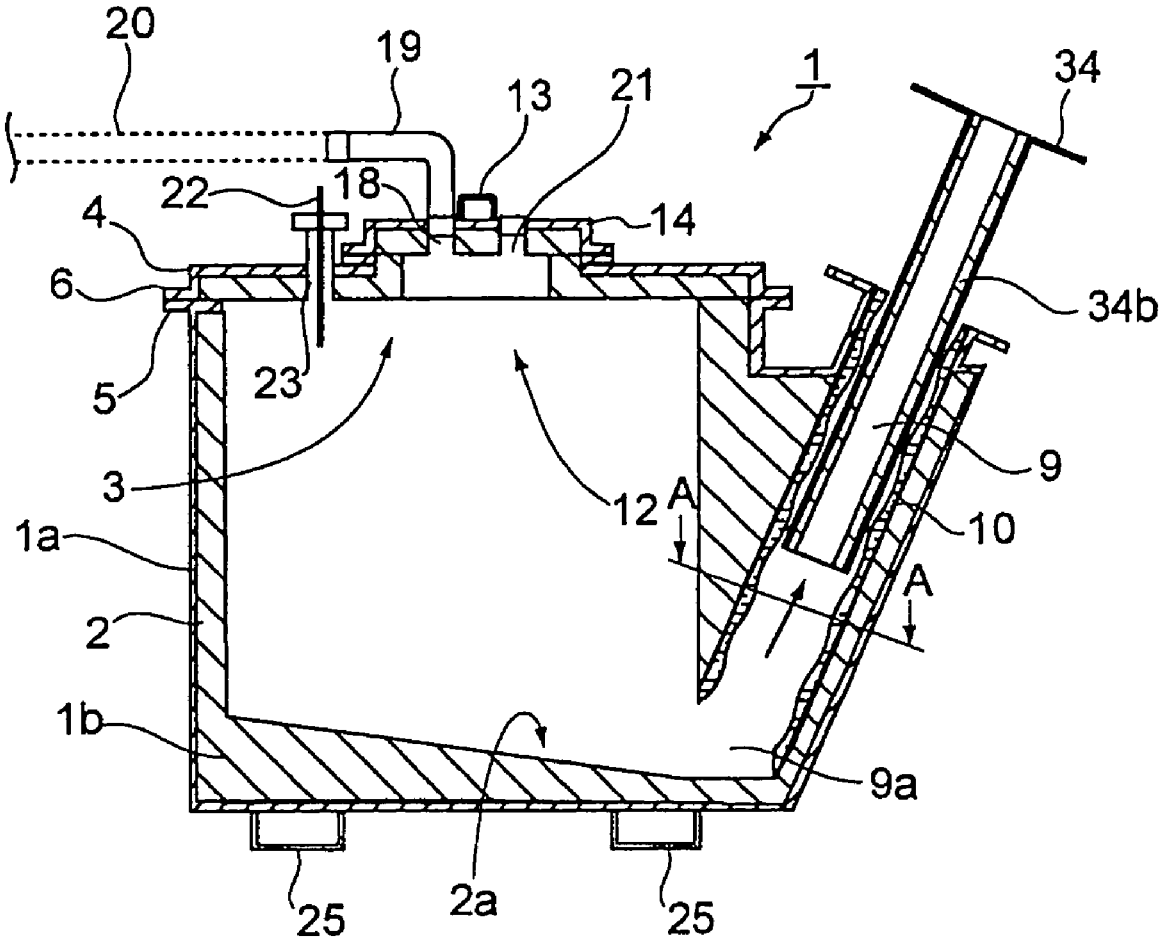
FIG. 4 is a cross-sectional view of the container according to an embodiment of the present invention.
Figure 5:
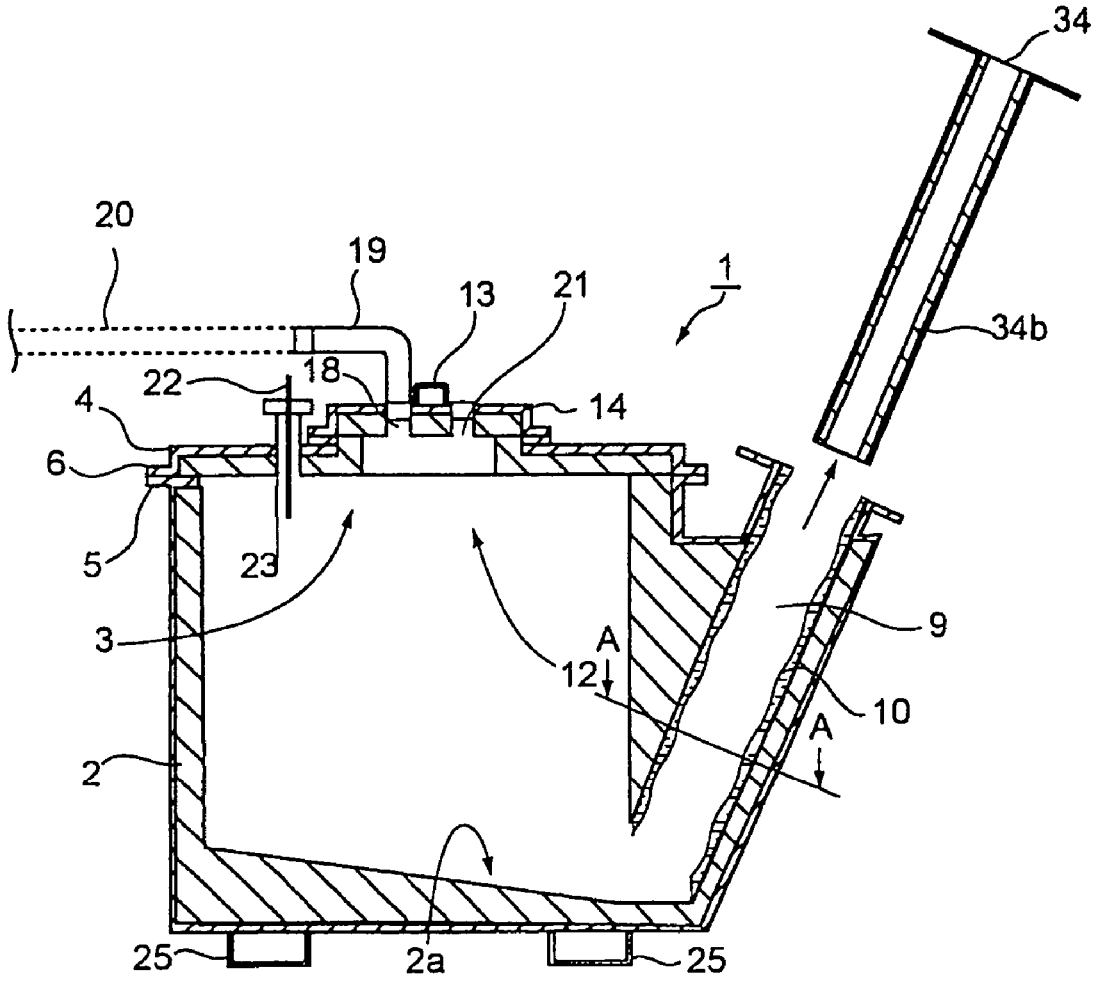
FIG. 5 is a cross-sectional view of the container according to an embodiment of the present invention.

Firstly, as shown in FIG. 4, the pipe 34 is mechanically taken off by destroying the filling material 10 inserted between the lining 1*b* and the pipe 34. Since the filling material 10 is weak in the strength and larger in the brittleness than the lining 1*b*, the filling material can easily be destroyed without adversely affecting the lining 1*b*. FIG. 5 shows a state where the pipe 34 is being removed. It is preferable to remove the filling material layer 10, which is a pipe protective layer, after the pipe 34 is being removed.

Figure 6:
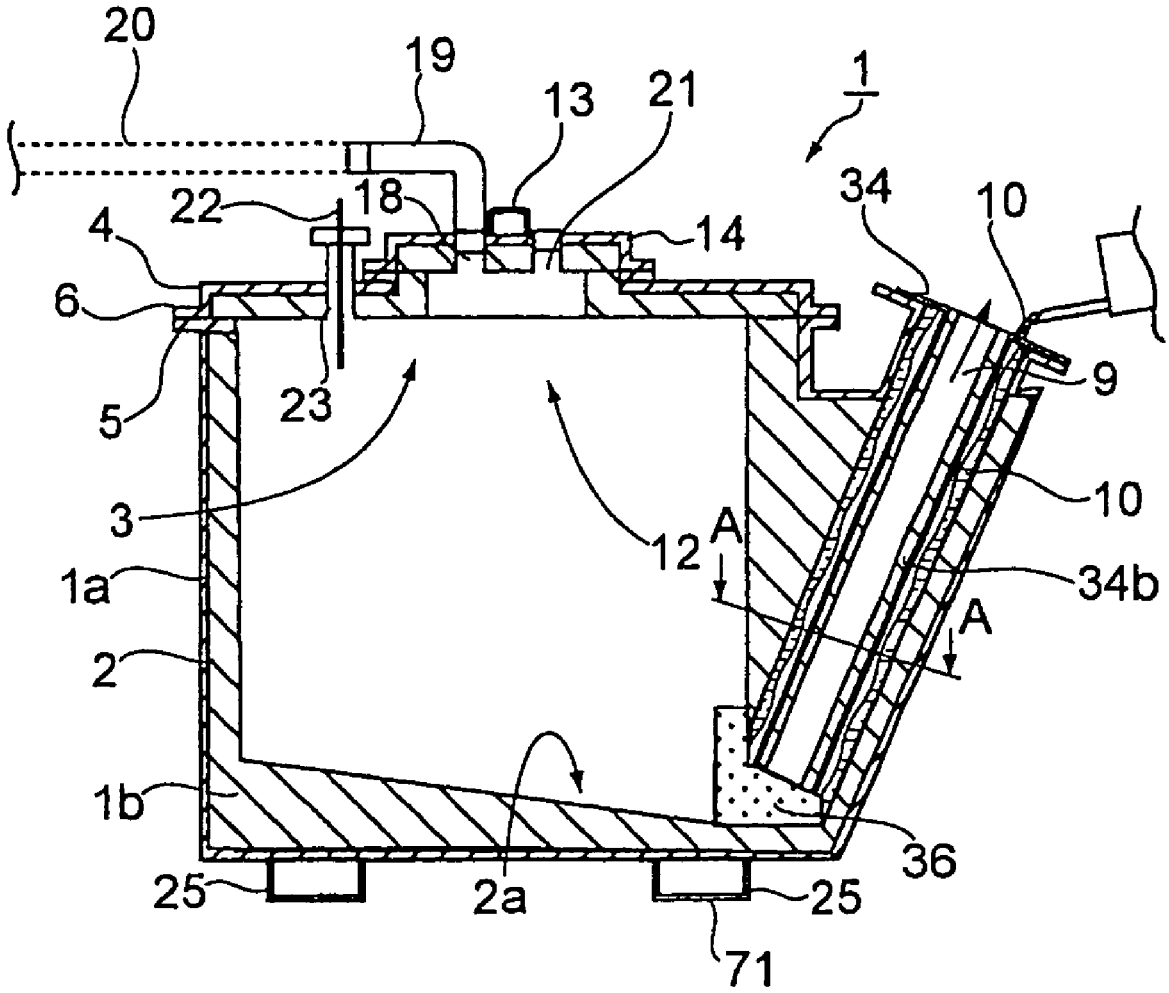
FIG. 6 is a cross-sectional view of the container according to an embodiment of the present invention.

Next, as shown in FIG. 6, while disposing in the container 1 a jig 36 that holds a new pipe 34 at a predetermined position and prevents the filling material from leaking, the pipe 34 is inserted into the flow path 9 and a filling material 10 having the fluidity is poured into a gap between the pipe and the flow path. Then the process is followed by drying and sintering to solidify the filling material 10. Thereafter, the jig 36 is removed. After the filling material 10 hardens, the bulk density becomes from substantially 1.2 to substantially 0.6, that is, the filling material 10 and becomes porous as it loses a binder. Accordingly, due to higher porosity state, the strength of the filling material becomes much weaker.

Figure 7:
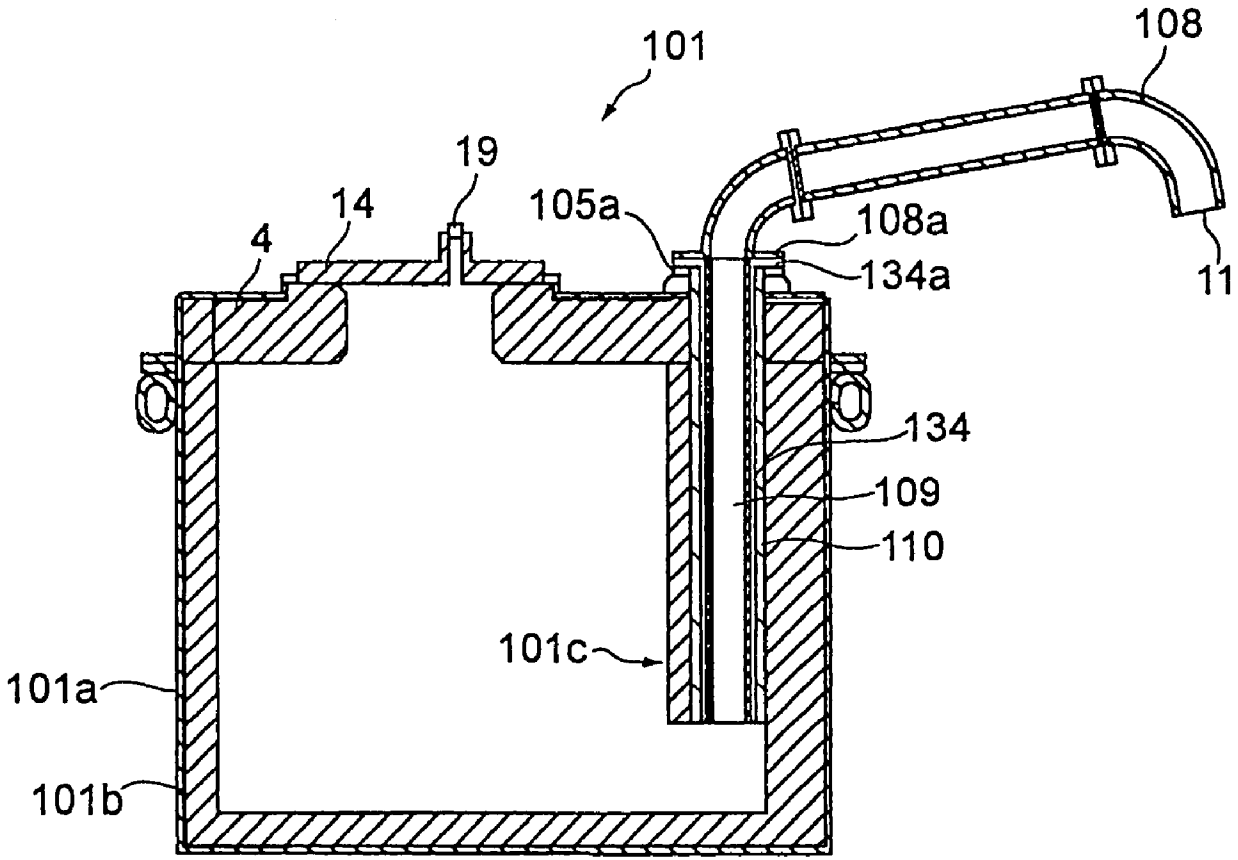
FIG. 7 is a cross-sectional view of the container according to an embodiment of the present invention.
Figure 8:
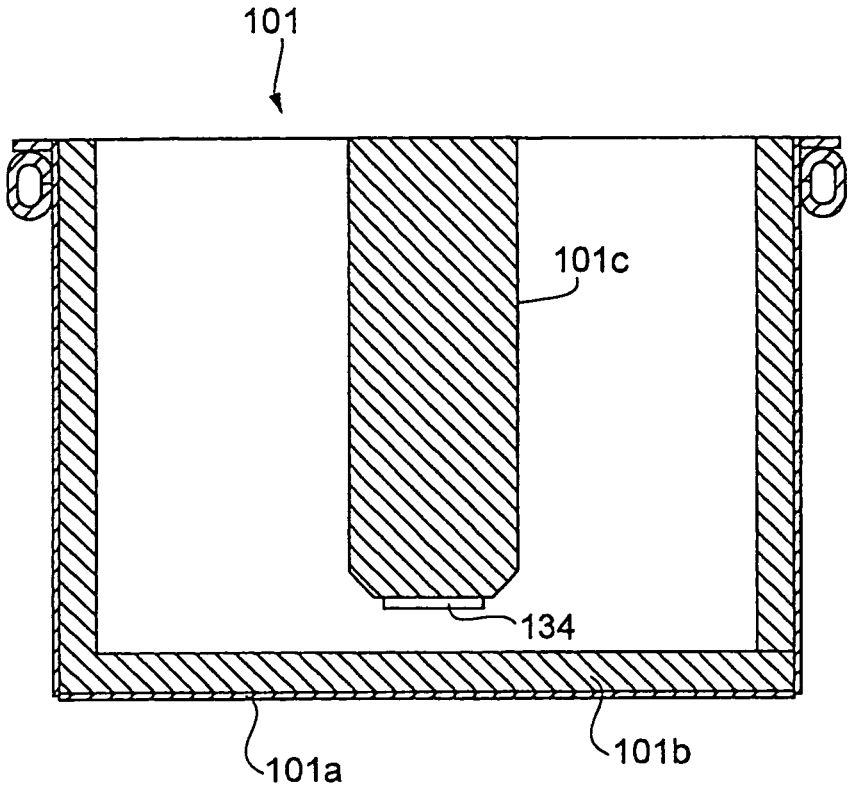
FIG. 8 is a cross-sectional view of the container according to an embodiment of the present invention.
Figure 9:
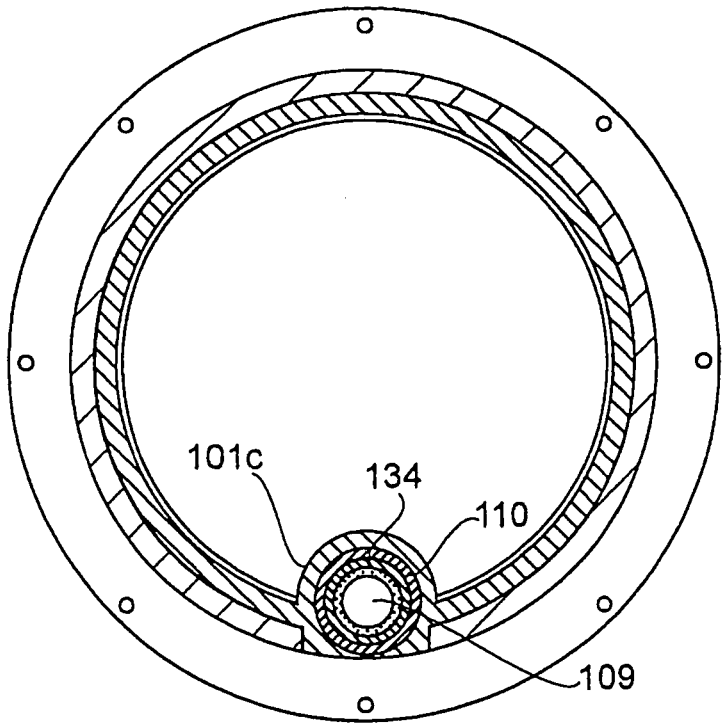
FIG. 9 is a cross-sectional view of the container according to an embodiment of the present invention.

Next, embodiments of the present invention will be described with reference to the FIG. 7, FIG. 8 and FIG. 9.

A container 101 of this embodiment is different in a structure of a flow path from that of the above-described embodiment. In other words, inside of a frame 101*a*, a lining 101*b* having a protruding portion 101*c* protruding toward inside the container is disposed along a vertical direction. The lining 101*b* is preferably formed into a multi-layered structure of a refractory layer and a heat insulating layer similarly to the above embodiment. These materials may also be similar to that of the above embodiment.

Inside of the protruding portion 101*c*, a flow path 109 that penetrates through from a position close to an inner bottom portion of the container 101 to a top surface side of the container 101 is disposed.

The flow path 109 is surrounded with a pipe 134 made of a metal such as iron or ceramics. An inner wall of the pipe 134 is covered with a refractory member 134*b*. Thereby, the heat-resisting property of the pipe 134 is improved. Furthermore, the pipe 134 is buried through a filling material 110 in the lining 101*b*. The filling material 110 is lower in the strength than the lining 101*b*. These materials may also be similar to that of the above embodiment. When the pipe 134 is not used, a gas for applying pressure and the like tends to intrude through cracking of the lining layer 101*c* causing inconvenience. However, according to the invention, such an intrusion of gas can be prevented. Accordingly, the molten metal can be stably supplied.

To an upper portion of the flow path 109, for example, a pipe 108 is detachably connected. The pipe 108 is, for example, made of an iron (the inner wall being covered with refractory member) and has, for instance, a R-shape or T-shape. This structure allows the molten metal to flow more smoothly. The flow path 109 and the pipe 108 linking thereto are preferably approximately the same in inner diameter, approximately 65 mm to approximately 85 mm.

Figure 21:
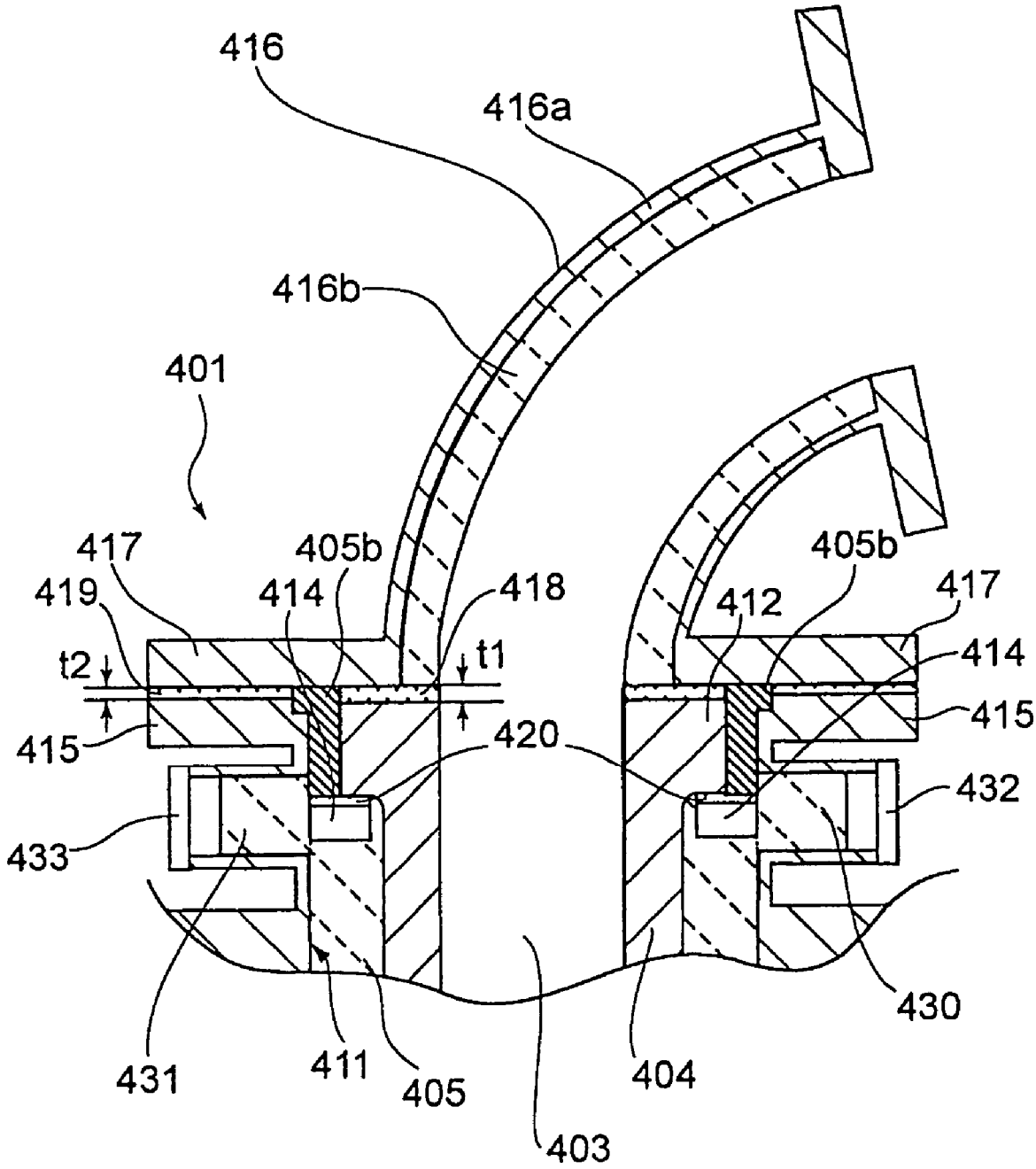
FIG. 21 is a partially enlarged cross-sectional view of a container shown in FIG. 18.

At an upper end portion of the pipe 134 a first flange 134*a* is disposed, and to the frame 101*a* a second flange 105*a* that is in contact with a lower surface of the first flange 134*a* is disposed so as to surround a periphery of the piping 134. Here, an outer diameter of the first flange 134*a* is set smaller than that of the second flange 105*a*. Thereby, heat radiated from the pipe 134 can be made smaller and the heat-retention effect of the flow path 109 can be improved. Of course, a structure as shown in FIG. 21 may be adopted. The flange 108*a* of the pipe 108 is fastened to the container 101 side through a bolt omitted from showing in the drawing. In addition, packing is inserted between the flanges.

In the present embodiment, in particular, since the flow path 109 penetrates through like a tunnel the inside of the protruding portion 101*c* of the lining, protruding from a position close to the inner bottom portion of the container 101 up to a top surface side of the container 101, an area of an inner wall of the container 101 that surrounds the flow path 109 becomes substantially larger, therefore, an amount of heat that is transmitted from molten aluminum in contact with the inner wall of the container 101 to the flow path 109 becomes larger. As a result, the heat-retention property of the flow path 109 can be improved and the fluidity of the molten metal can be maintained.

Figure 10:
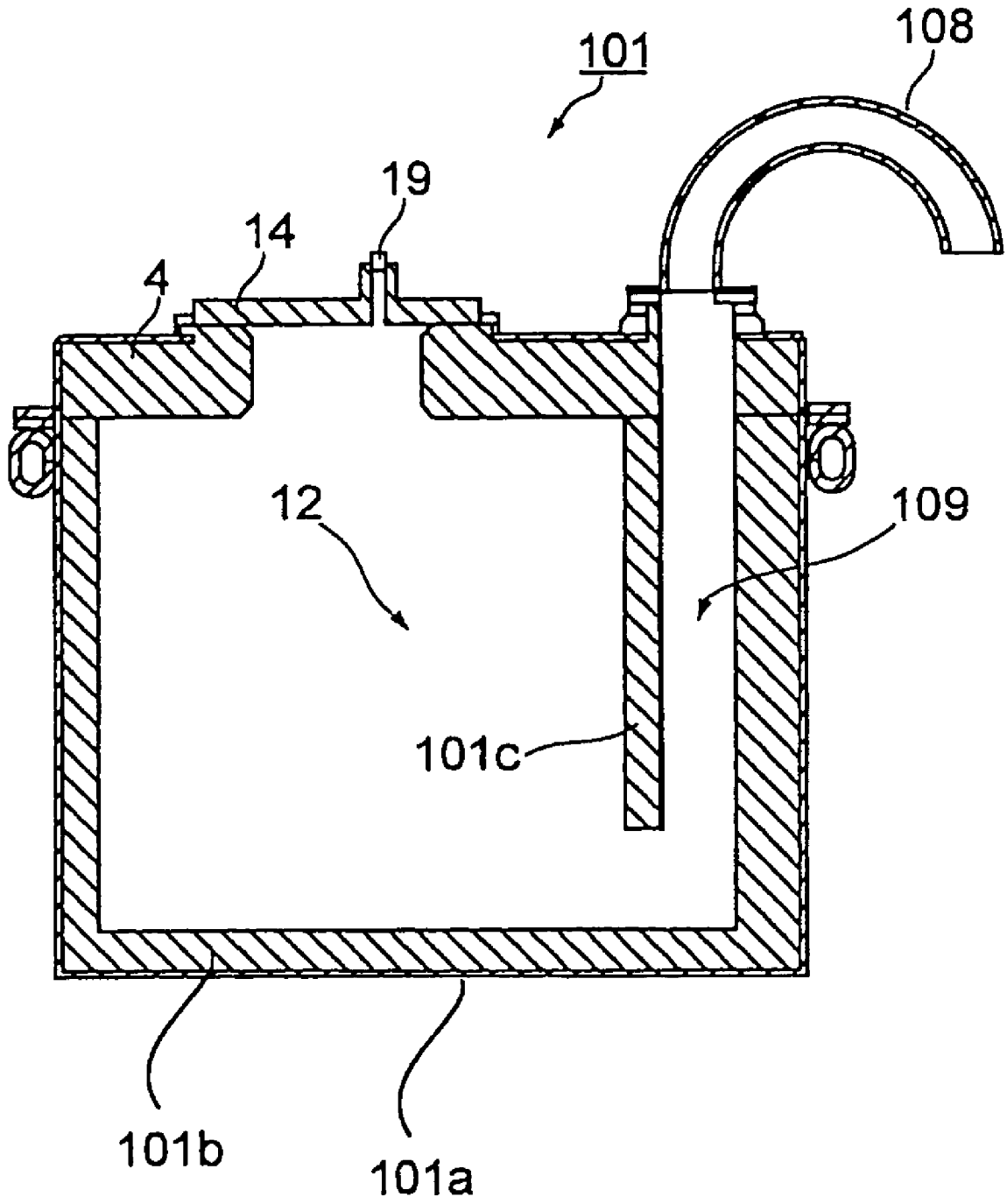
FIG. 10 is a cross-sectional view of the container according to an embodiment of the present invention.
Figure 11:
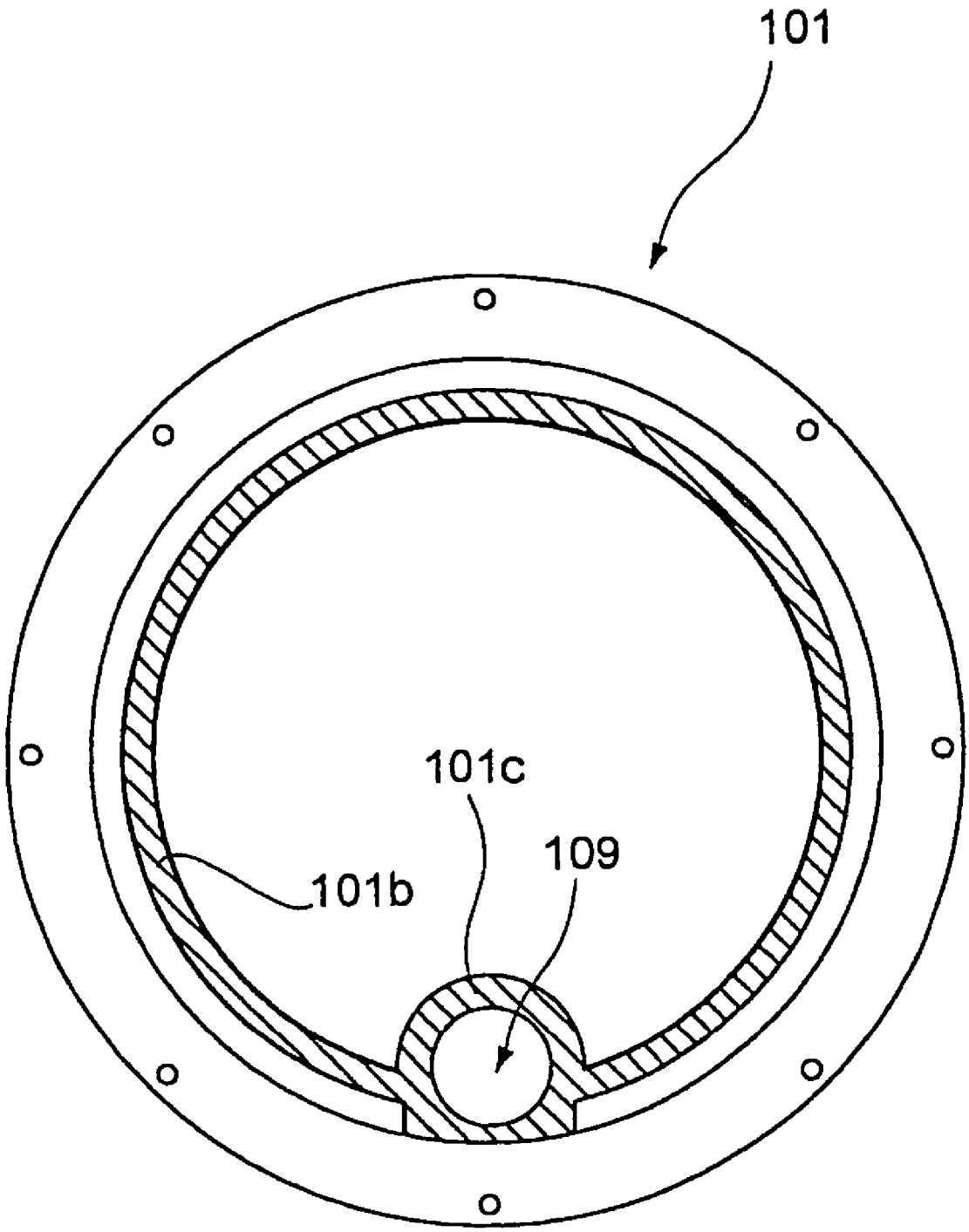
FIG. 11 is a cross-sectional view of the container according to an embodiment of the present invention.

Further, as shown in FIG. 10 and FIG. 11, even in a configuration where the flow path 109 being not surrounded by the pipe, similar effect that the heat retention property of the flow path 109 being increased can be obtained.

Figure 12:
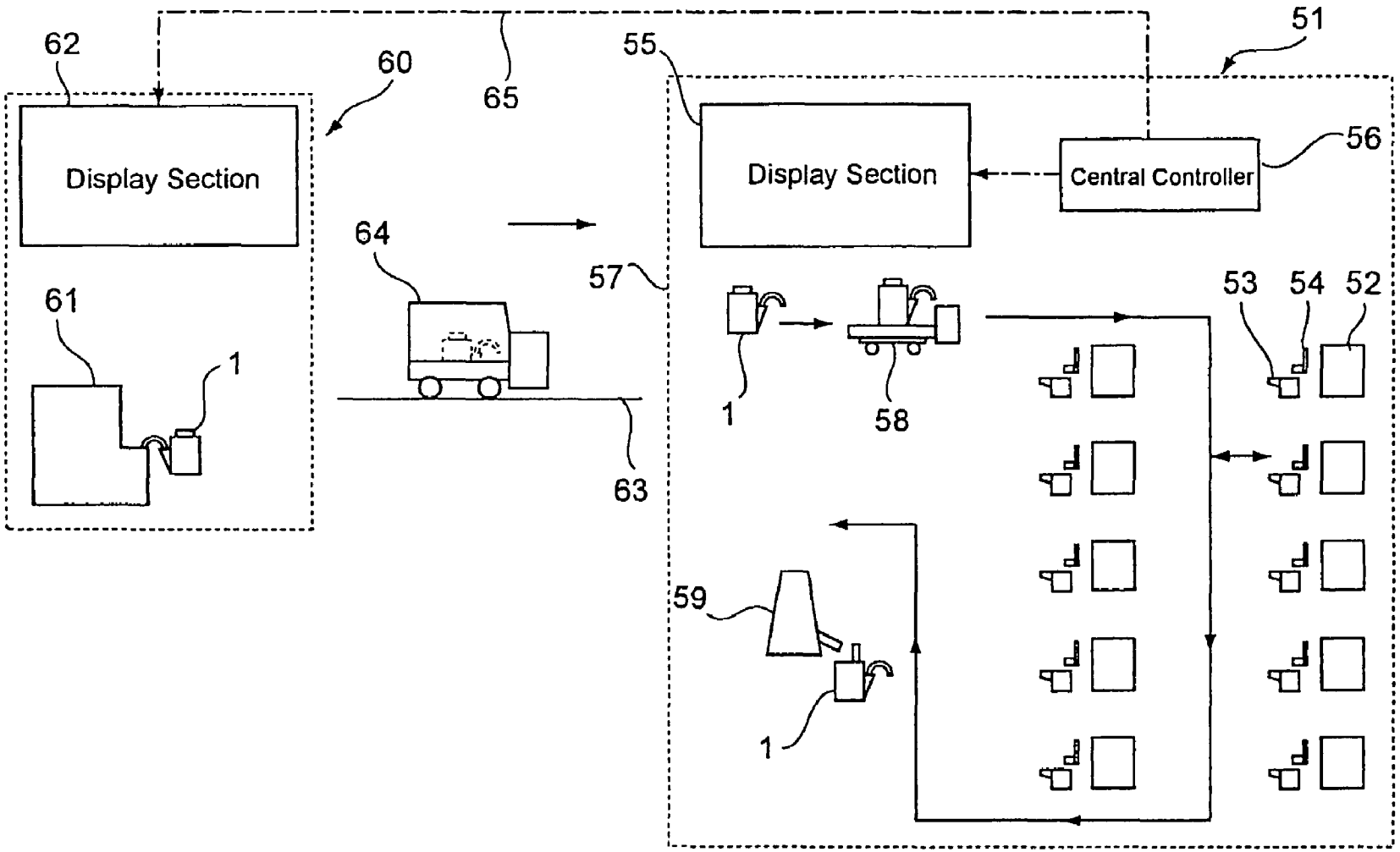
FIG. 12 is a schematic drawing showing the configuration of a metal supply system according to an embodiment of the present invention.

FIG. 12 is a drawing showing the entire configuration of a metal supply system according to an embodiment of the present invention.

As shown in the drawing, a first factory 51 and a second factory 60 are provided at locations apart from each other across, for example, a public road 63.

In the first factory 51, a plurality of die casting machines 52 are arranged as use points. Each of the die casting machines 52 molds products in a desired shape by injection molding using molten aluminum as a raw material. The products can include, for example, parts relating to an engine of an automobile and the like. Besides, the molten metal is not limited only to an aluminum alloy, but alloys containing other metals such as magnesium, titanium, and so on as main constituents are also usable. Near the die casting machines 52, there are storing furnaces (local storing furnaces) 53 that temporarily store molten aluminum before shots. This local storing furnace 53 is designed to store the molten aluminum for a plurality of shots, so that the molten aluminum is injected from the storing furnace 53 into the die casting machine 52 through a ladle 54 or a pipe for every shot. Further, each of the storing furnaces 53 is provided with a level sensor (not shown) that detects the level of the molten aluminum stored in a container and a temperature sensor (not shown) that detects the temperature of the molten aluminum. Detection results by these sensors are passed to a control panel of each of the die casting machines 52 or a central controller 56 in the first factory 51.

At a receiving station of the first factory 51, a receiving table 57 is disposed for receiving a later-described container 1. The container 1 received at the receiving table 57 in the receiving section is delivered by a delivery vehicle 58 to a predetermined die casting machine 52, so that the molten aluminum is supplied from the container 1 to the storing furnace 53. After the completion of the supply, the container 1 is returned to the receiving table 57 in the receiving section again with the delivery vehicle 58.

In the first factory 51, a first furnace 59 is provided for melting aluminum and supplying it to the container 1, and the container 1, supplied with the molten aluminum from the first furnace 59, is also delivered with the delivery vehicle 58 to a predetermined die casting machine 52.

In the first factory 51, a display section 55 is disposed which displays a fact that the die casting machines 52 demand for the additional aluminum melt. More specifically, for example, a unique number is given to every die casting machine 52 and displayed on the display section 55, so that the number on the display section 55 corresponding to the die casting machine 52 which needs addition of the molten aluminum is lighted up. Based on the display on the display section 55, an operator carries the container 1 to the die casting machine 52 corresponding the number using the delivery vehicle 58 to supply the molten aluminum. The display on the display section 55 is performed by a control of the central controller 56 based on the detection result by the level sensor of the aluminum melt.

In the second factory 60, a second furnace 61 is provided for melting aluminum and supplying it to the container 1. A plurality of types of container 1 are provided which are different, for example, in capacity, pipe length, height, width, and so on. For example, there is a plurality of types of container 1 different in capacity in accordance with the capacities or the like of the local storing furnaces 53 for the die casting machines 52 in the first factory 51. However, it is, of course, adoptable to unify the container 1 into one standard.

The container 1 supplied with the molten aluminum from the second furnace 61 is mounted on a truck 64 for carriage by means of a fork lift truck (not shown). The truck 64 carries the container 1 through the public road 63 to near the receiving table 57 in the receiving station in the first factory 51, so that the container 1 are received at the receiving table 57 by means of a forklift (not shown). Besides, vacant container 1 placed in the receiving station is returned to the second factory 60 by the truck 64.

In the second factory 60, a display section 62 is disposed which states a fact that the die casting machines 52 in the first factory 51 call for additional molten aluminum. The display section 62 is almost the same in configuration as the display section 55 in the first factory 51. The display on the display section 62 is performed by a control of the central controller 56 in the first factory 51, for example, via a communication line 65. It should be noted that, out of the die casting machine 52 which need supply of the molten aluminum, the die casting machine 52, which are determined to be supplied with the molten aluminum from the first furnace 59 in the first factory 51, are displayed in distinction from the other die casting machines 52 on the display section 62 in the second factory 60. For example, it is designed to blink the numbers corresponding to the die casting machines 52 determined as above. This can prevent the molten aluminum from being supplied by mistake from the second factory 60 side to the die casting machines 52 which have been determined to be supplied with the molten aluminum from the first furnace 59. Further, on this display section 62, data transmitted from the central controller 56 is also displayed in addition to the above display.

Next, description will be made on the action of the metal supply system configured as described above.

The central controller 56 monitors the amount of the molten aluminum in each of the storing furnaces 53 through the level sensor provided at each of the local storing furnaces 53. When there arises a demand for supplying the molten aluminum to one storing furnace 53, the central controller 56 transmits to the second factory 60 side through the communication line 65 the "ID number" of the storing furnace 53, "temperature data" of the storing furnace 53 detected by the temperature sensor provided at the storing furnace 53, "form data" on the form (described later) of the storing furnace 53, final "time data" of the storing furnace 53 running out of the molten aluminum, "traffic data" of the public road 63, "amount data" of the molten aluminum required for the storing furnace 53, "temperature data", and so on. In the second factory 60, these data are displayed on the display section 62. Based on these displayed data, the operator determines on his or her experiences the point of time for dispatch of the container 1 from the second factory 60 and the temperature of the molten aluminum at the time of the dispatch so that the container 1 is delivered to the storing furnace 53 immediately before the storing furnace 53 runs out of the molten aluminum and the molten aluminum at that time is at a desired temperature. Alternatively, the data may be downloaded into a computer (not shown) and using the predetermined software, the point of time for dispatch of the container 1 from the second factory 60 and the temperature of the molten aluminum at the time of the dispatch so that the container 1 is delivered to the storing furnace 53 immediately before the storing furnace 53 runs out of the molten aluminum and the molten aluminum at that time is at a desired temperature may be estimated and displayed. Alternatively, it is also adoptable to automatically control the temperature of the second furnace 61 based on the estimated temperature. It is also adoptable to determine the amount of the molten aluminum to be stored in the container 1 based on the aforementioned "amount data."

When the truck 64 with the container 1 mounted thereon departs, passes the public road 63, and arrives at the first factory 51, the container 1 is received from the truck 64 at the receiving table 57 in the receiving station.

Then, the received container 1 is delivered together with the receiving table 57 to a predetermined die casting machine 52 by the delivery vehicle 58 so that the molten aluminum is supplied from the container 1 to the storing furnace 53.

Next, a supply system from the second furnace 61 to the container 1 in the second factory 60 will be described with reference to FIG. 13.

Figure 13:
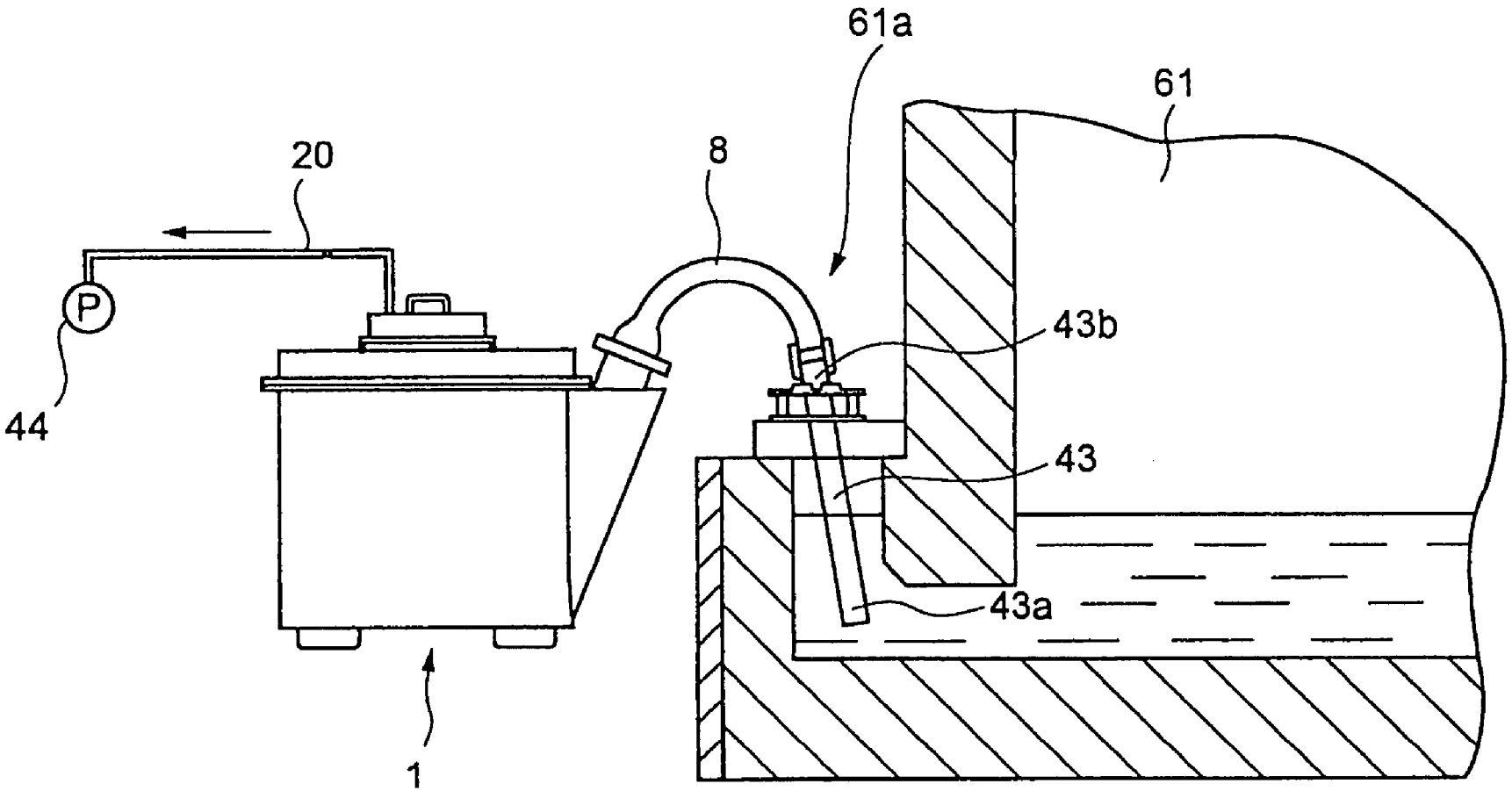
FIG. 13 is a view schematically showing an example of the configuration of the container and a melting furnace of the present invention.

As shown in FIG. 13, the second furnace 61 stores the molten aluminum. The second furnace 61 is provided with a supply section 61*a* into which a suction pipe 43 is inserted. The suction pipe 43 is disposed such that one end port (another tip portion 43*b* of the suction pipe 43) appears from and disappears into the liquid surface of the molten aluminum in the supply section 61*a*. More specifically, one tip portion 43*a* of the suction pipe 43 extends close to the bottom portion of the second furnace 61, and the other tip portion 43*b* of the suction pipe 43 is drawn outward from the supply section 61*a*. The inclination angle is, for example, about 10 degrees with respect to the vertical line so that the inclination matches that of the tip portion of the pipe 8 of the above-described container 1. The tip portion 43*b* of the suction pipe 43 is to be connected to the tip portion of the pipe 8 of the container 1, and the matching of the inclinations thus facilitates connection between the tip portion 43*b* of the suction pipe 43 and the tip portion of the pipe 8 of the container 1. Furthermore, due to removal of gas such as hydrogen dissolved in the molten metal, quality of the molten metal can be improved.

Then, the pipe 20 connected to a pump 44 for reducing the pressure is connected to the pipe 19. Subsequently, the pump 44 is started to reduce pressure in the container 1. This allows the molten aluminum stored in the second furnace 61 to be introduced into the container 1 through the suction pipe 43 and the pipe 8.

In this embodiment, in particular, the molten aluminum stored in the second furnace 61 is introduced into the container 1 through the suction pipe 43 and the pipe 8, so that the molten aluminum never comes into contact with outside air. Therefore, no oxide is generated, and as a result, the molten aluminum supplied using this system is very excellent in quality. In addition, the work of removing oxide from the container 1 also becomes unnecessary, resulting in improved productivity.

In this embodiment, in particular, introduction of the molten aluminum into the container 1 and discharging of the molten aluminum from the container 1 can be performed using substantially only two pipes, thus enabling the system configuration to be very simple. Further, since possibilities of the molten aluminum of coming into contact with the outside air sharply decreases, generation of oxides can almost be eliminated.

Figure 14:
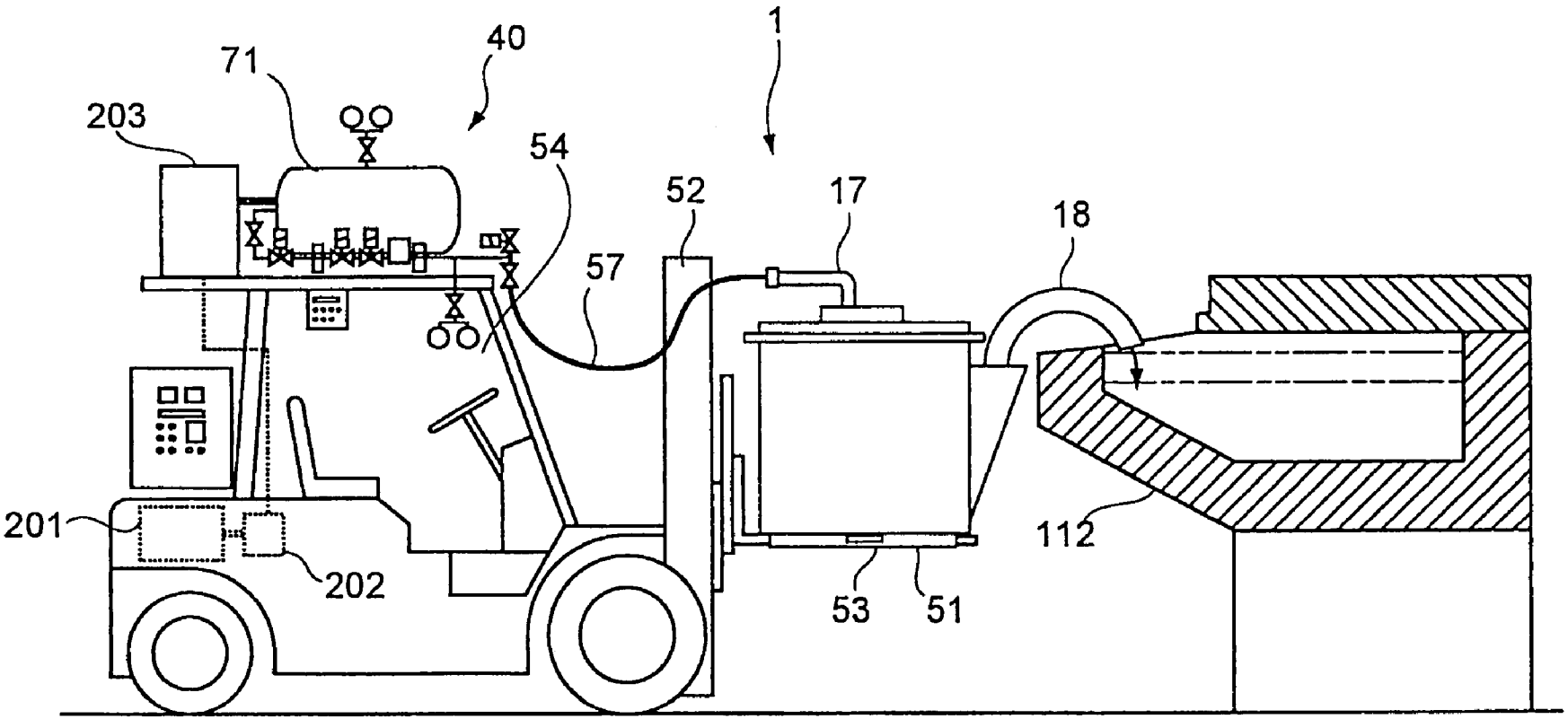
FIG. 14 is a drawing for explaining an example of a delivery model of metal using the supply apparatus and the container of the present invention.

As shown in FIG. 14, this example is configured such that compressed air is sent out from a reservoir tank 39 into the hermetic type container 1 to cause the molten aluminum stored in the container 1 to be discharged through the pipe 8 and supplied to the storing furnace 53. Note that numeral 40 denotes a pressure valve, and numeral 41 denotes a leak valve in FIG. 2.

Here, the storing furnaces 53 have various heights, and the tip of the pipe 8 is adjustable to be placed at an optimal position above the storing furnace 53 by means of a rising and lowering mechanism provided on the delivery vehicle 58. The rising and lowering mechanism, however, cannot cope by itself with the storing furnace 53 depending on its height in some cases. Hence, in this system, data regarding the height of the storing furnace 53, the distance to the storing furnace 53, and so on are previously sent to the second factory 60 side as the "form data" regarding the form of the storing furnace 53, and on the second factory 60 side, for example, the container 1 having an optimal form, for example, an optimal height is selected and delivered based on the data. Note that the container 1 having an optimal size may be selected and delivered in accordance with the amount to be supplied.

Figure 15:
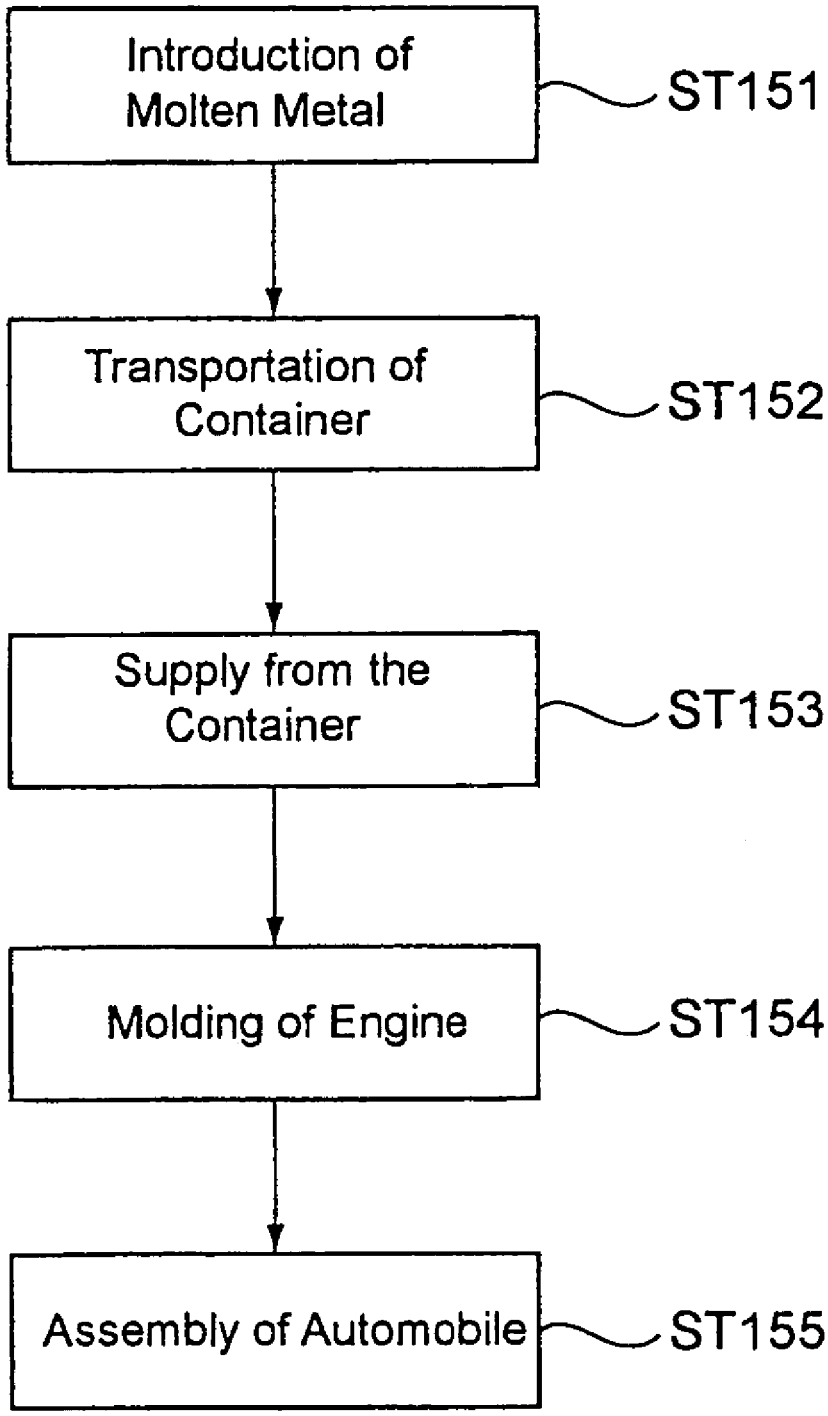
FIG. 15 is a flowchart showing a method for manufacturing an automobile using the system of the present invention.

FIG. 15 shows a manufacturing flow of the above-described system when applied to an automobile factory.

First, as shown in FIG. 13, the molten aluminum stored in the second furnace 61 is introduced (molten metal is received) into the container 1 through the suction pipe 43 and the pipe 8 (Step 151).

Then, as shown in FIG. 12, the container 1 is transported with the truck 64 through the public road 63 from the second factory 60 to the first factory 51 (Step 152).

Then, in the first factory (use point) 10, the container 1 is delivered with the delivery vehicle 58 to the die-casting machine 52 for manufacturing an automobile engine, and the molten aluminum is supplied from the container 1 to the storing furnace 53 (Step 153).

Then, the die casting machine 52 molds the automobile engine using the molten aluminum stored in the storing furnace 53 (Step 154).

At last, an automobile is assembled using the automobile engine thus molded and other parts, resulting in a complete automobile (Step 155).

In this embodiment, the automobile engine is made of aluminum containing little or no oxide as described above, thus making it possible to manufacture an automobile having an engine excellent in performance and durability.

Figure 16:
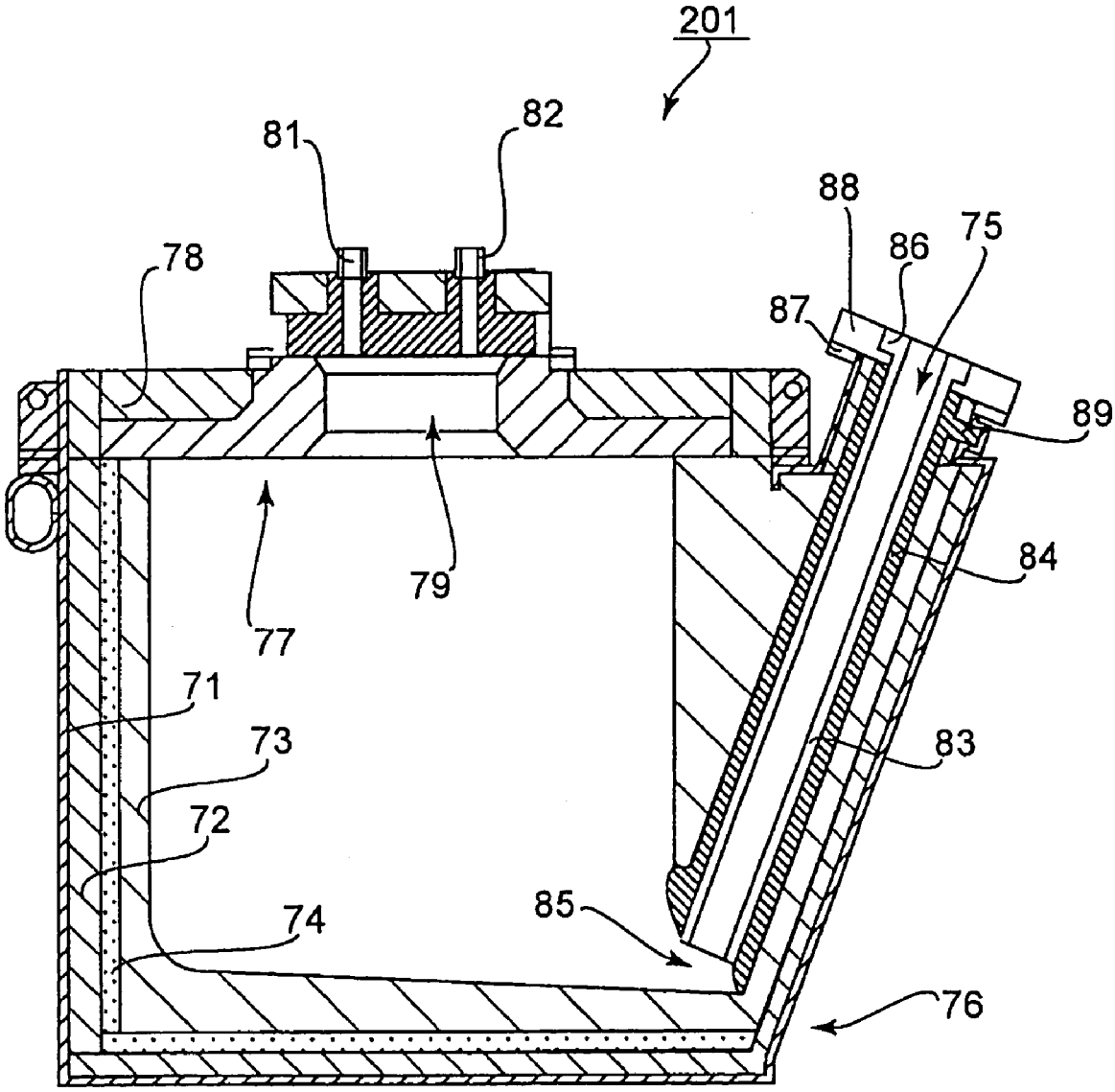
FIG. 16 is a cross-sectional view of the container according to an embodiment of the present invention.

FIG. 16 is a cross-sectional view of the container according to another embodiment of the present invention.

A container 201 has, inside of a frame 71, a structure in which as a lining a heat insulator 72 and a refractory member 73 are multi-layered. A board material 74 is inserted between the heat insulator 72 and the refractory member 73 at a predetermined position. The refractory member 73 is provided inside a flow path 75 for flowing molten metal between the inside and the outside of the container. The container 201 is configured such that a large lid 78 is provided at an upper opening portion 77 of a bottomed cylindrical body 76 and, a large lid and the body 76 are connected with the bolts provided between flanges.

In addition, by inversely rotating the bolts with handles to release the fixation, the hatch 80 can be opened from the opening portion 79 in the large lid 78. Then, with the hatch 80 being opened, maintenance of the inside of the container 201 and insertion of a gas burner at the time of preheating can be performed through the opening portion 79.

At approximately the center of the aforementioned large lid 78, an opening portion 79 is provided, and a hatch 80 attached thereto is disposed at the opening portion 79. A passage 81 for internal pressure adjustment for reducing and applying the pressure in the container 201 is provided at a center or a position slightly off from the center of the hatch 80. To the passage 81, a pipe for applying and reducing the pressure (not shown) is connected. To the end of the pipe, a pipe for applying pressure and a tank for storing a gas for applying pressure and a pump for applying pressure is connected, and to a pipe for reducing pressure, a pump for reducing the pressure is connected. Then, by making use of pressure difference caused by reduction of pressure, the molten aluminum can be introduced through the pipe into the container 201, and by making use of pressure difference caused by application of the pressure, the molten aluminum can be discharged to the outside of the container 201 through the pipe.

At a position that is a little deviated from a center of the hatch 80 and located opposite to a passage 81 for applying and reducing pressure, a passage 82 for inserting an electrode (not shown in the drawing) for detecting a liquid level is disposed.

On the rear face of the bottom portion of the body 76, two channels having a cross section in a square shape into which, for example, a fork of the fork lift truck (not shown) is inserted and having a predetermined length, are disposed, for example, parallel to each other. Further, the entire bottom portion inside the body 76 is inclined to be low on the flow path side. This reduces so-called remained melt when the molten aluminum is supplied to the outside by compression. In addition, when the container 201 is tilted, for example, at the time of maintenance to pour the molten aluminum to the outside through the flow path 75 and the pipe 83, the angle of tilting the container 201 can be decreased, providing improved safety and workability.

Here the flow path 75 is surrounded with a pipe 83 made of a metal ceramics such as silicon nitride. Furthermore, the pipe 83 is buried through a filling material 84 in the refractory member 73. The filling material 84 is lower in the strength than the refractory member 73. Since the ceramics pipe 83 is excellent in the refractoriness, there is no need of disposing a refractory material to an inner wall. Thereby, the heat-resisting property of the pipe 83 is improved. The strength here mainly means the bending strength against external mechanical stress, and as bulk density becomes larger the strength becomes relatively lower. As the lining 72, for example, dense fire resistant ceramics materials can be cited, and as the filling material 84 having lower strength than that of ceramics material, for example, materials made of ceramics fiber and binder can be cited.

The flow path 75 thus surrounded with the pipe 83 extends through an opening 85 disposed at a position close to a bottom portion of the container body of an inner periphery of the body 76 toward an upper portion of an outer periphery of the body 76.

To an upper portion of the flow path 75, for example, an iron (an inner wall being covered with a refractory member) R-shaped pipe (not shown in the drawing) is detachably connected with a bolt.

At an upper end portion of the pipe 83, a first flange 86 is disposed, and to the frame 71 a second flange 87 disposed opposite to a bottom surface of the first flange 86 is disposed so as to surround a periphery of the pipe 83. Between the first flange 86 and the second flange 87, a flange member 88 for receiving and fastening the ceramics pipe 83 is inserted. Reference numeral 89 denotes a hole for injecting the filling material 84. The hole 89 is normally, hermetically sealed with a cap except for the time of maintenance.

Figure 17:
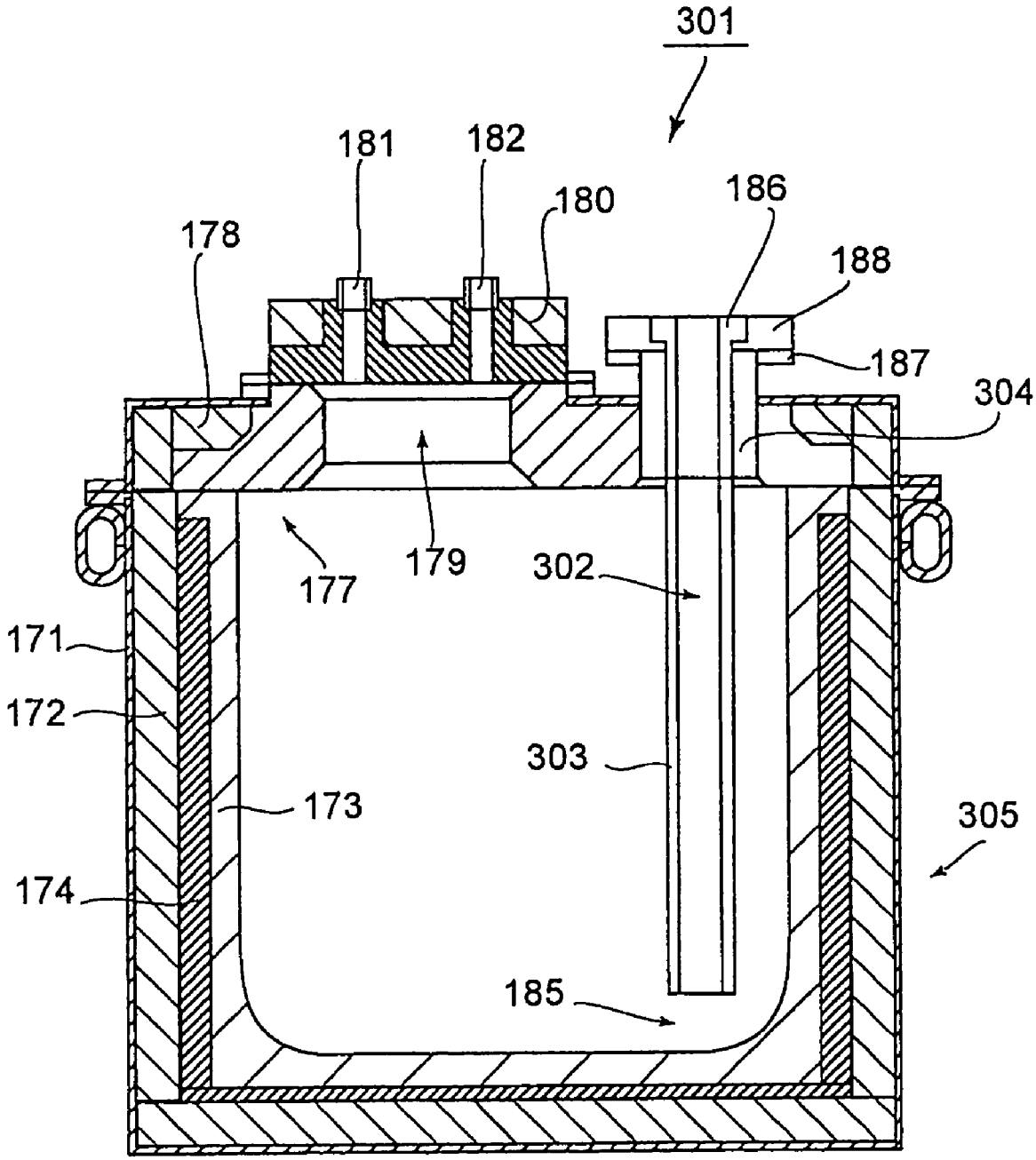
FIG. 17 is a cross-sectional view of the container according to an embodiment of the present invention.

FIG. 17 is a sectional view showing another embodiment of the present invention.

In the present embodiment, a pipe 303 (stoke) that constitutes a flow path 302 is vertically disposed in the container. Accordingly, in the case of molten metal being present in the container 301, the pipe 302 directly comes into contact with the molten metal. The pipe 302 is made of ceramics such as silicon nitride. Thereby, the refractoriness is increased and the clogging of the pipe can be prevented. To an upper portion of the flow path 302, for example, a pipe made of iron (omitted from showing in the drawing) with R shape is connected. In the embodiment, the omitted pipe is allowed to turn. Thereby, the laying in a narrow region can be made easier. Reference numeral 304 denotes a member that rotatably holds the pipe 303.

A container 301 has, inside of a frame 171, a structure in which as a lining a heat insulator 172 and a refractory member 173 are multi-layered. A board material 174 is inserted between the heat insulator 172 and the refractory member 173 at a predetermined position. The container 301 is configured such that a large lid 178 is provided at an upper opening portion 177 of a bottomed cylindrical body 305 and, the large lid and the body are connected with bolts provided between the flanges.

At approximately the center of the aforementioned large lid 178, an opening portion 179 is provided, and a hatch 180 that freely opens and closes is disposed at the opening portion 179. A passage 181 for internal pressure adjustment for reducing and applying the pressure in the container 301 is provided at a center or a position slightly off from the center of the hatch 180. To the passage 181, a pipe for applying and reducing the pressure (not shown) is connected. To the end of the pipe, a pipe for applying pressure and a tank for storing a gas for applying pressure and a pump for applying pressure is connected, and to a pipe for reducing pressure, a pump for reducing the pressure is connected. Then, by making use of pressure difference caused by reduction of pressure, the molten aluminum can be introduced into the container 301, and by making use of pressure difference caused by application of the pressure, the molten aluminum can be discharged to the outside of the container 301.

At a position that is a little deviated from a center of the hatch 180 and located opposite to a passage 181 for applying and reducing pressure, a pare of passages 182 for inserting electrode (not shown in the drawing) for detecting a liquid level is disposed.

On the rear face of the bottom portion of the body 301, two channels having a cross section in a square shape into which, for example, a fork of the fork lift truck (not shown) is inserted and having a predetermined length, are disposed, for example, parallel to each other.

Here, the flow path 302 is surrounded with a pipe 303 made of a metal ceramics such as silicon nitride. Since the ceramics pipe 303 is excellent in the refractoriness, there is no need of disposing a refractory material to an inner wall. Thereby, the heat-resisting property of the pipe 303 is improved.

The flow path 302 thus surrounded with the pipe 303 extends through an opening 185 disposed at a position close to a bottom portion of the container body of an inner periphery of the body 305 toward an upper portion of an outer periphery of the body 305.

At an upper end portion of the pipe 303, a first flange 186 is disposed, and to the frame 171 a second flange 187 disposed opposite to a bottom surface of the first flange 186 is disposed so as to surround a periphery of the pipe 303. Between the first flange 186 and the second flange 187, a flange member 188 for receiving and fastening the ceramics pipe 303 is inserted.

Figure 18:
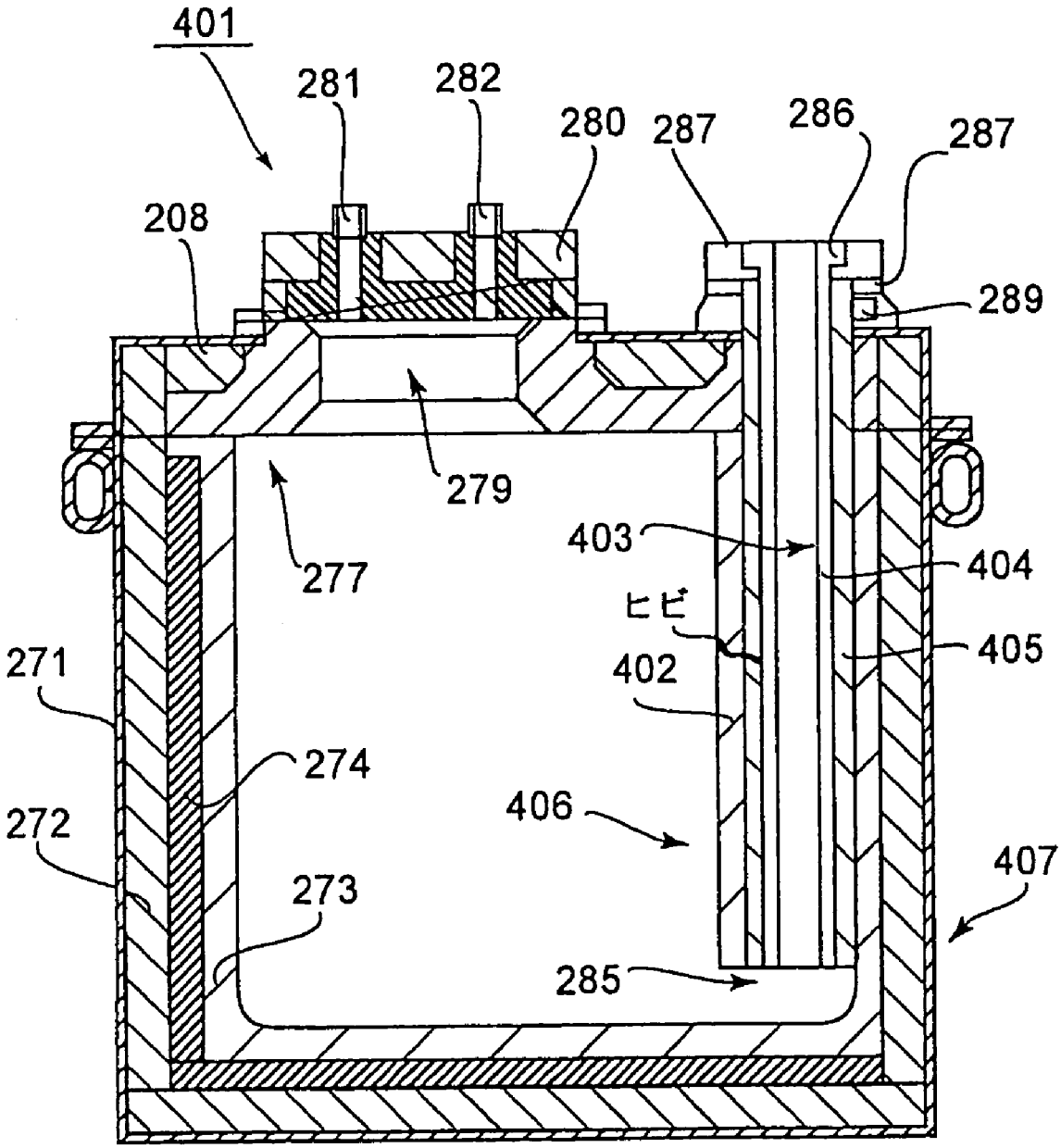
FIG. 18 is a cross-sectional view of the container according to an embodiment of the present invention.

FIG. 18 is a sectional view showing still another embodiment of the present invention.

In the present embodiment, as a lining, a refractory member 402 having a projecting portion 406 (such as FIG. 9) toward the inside of the container from bottom to an upper portion, the protruding portion 406 having a flow path 403 therein, the flow path 403 being covered with a pipe 404 made of ceramics such as silicon nitride. Furthermore, the pipe 404 is buried through a filling material 405 in the refractory member 402. The filling material 405 is lower in the strength than the refractory member 402. Since the ceramics pipe 404 is excellent in the refractoriness, there is no need of disposing a refractory material to an inner wall. To an upper portion of the flow path 403, for example, a pipe made of iron with R shape is connected. Reference numeral 405*b* denotes a heat insulator for keeping a temperature of a flange portion of the pipe 404, for instance ceramics fiber and so on being filled.

The container 401 has, inside of the frame 271, a structure in which as a lining a heat insulator 272 and a refractory member 273 are multi-layered. A board material 274 is inserted between the heat insulator 272 and the refractory member 274 disposed at a predetermined position. In addition, the container 401 is configured such that a large lid 278 is provided at an upper opening portion 277 of a bottomed cylindrical body 407 and, the large lid and the body 407 are connected with bolts provided between the flanges.

At approximately the center of the aforementioned large lid 278, an opening portion 279 is provided, and a hatch 280 that opens and closes freely is disposed at the opening portion 280. A passage 281 for internal pressure adjustment for reducing and applying the pressure in the container 401 is provided at a center or a position slightly off from the center of the hatch 280. To the passage 281, a pipe for applying and reducing the pressure (not shown) is connected.

At a position that is a little deviated from a center of the hatch 280 and located opposite to a passage 281 for applying and reducing pressure, a pair of passages 282 for inserting electrode (not shown in the drawing) for detecting a liquid level is disposed.

On the rear face of the bottom portion of the body 401, two channels having a cross section in a square shape into which, for example, a fork of the fork lift truck (not shown) is inserted and having a predetermined length, are disposed, for example, parallel to each other.

Here, the flow path 403 is surrounded with a pipe 404 made of a metal ceramics such as silicon nitride. Furthermore, the pipe 404 is buried through a filling material 405 in the refractory member 402. The filling material 405 is lower in the strength than the refractory member 402. Since the ceramics pipe 404 is excellent in the refractoriness, there is no need of disposing a refractory material to an inner wall. Thereby, the heat resisting property of the pipe 404 is improved. The strength here mainly means the bending strength against external mechanical stress, and as bulk density becomes larger the strength becomes relatively lower. As the lining 272, for example, dense fire resistant ceramics materials can be cited, and as the filling material 405 having lower strength than that of ceramics material, for example, materials made of ceramics fiber and binder can be cited.

The flow path 403 thus surrounded with the pipe 404 extends through an opening 285 disposed at a position close to a bottom portion of the container body of an inner periphery of the body 401 toward an upper portion of an outer periphery of the body 401.

In the present invention, in order to positively supply an amount of heat from a molten metal storing portion in the container to the pipe 286 side, the protruding portion is disposed inside of the lining and a hole that becomes a flow path like a tunnel is disposed inside the protruding portion. Furthermore, in the invention, in order to prevent a gas from intruding, due to the crack in the lining and the like, into the flow path of the molten metal (such as molten aluminum alloy and molten magnesium alloy) in the frame (pressurized gas is likely to intrude), a rigid pipe such as the ceramic pipe 286 is adopted to prevent the gas from intruding, and furthermore a replaceable cartridge structure is adopted as a fastening method of the pipe 286. When the pipe is not formed into a cartridge structure, every time when the pipe is replaced, almost all of the lining of the container has to be reinstalled, resulting in very high cost. However, when the pipe is formed into a cartridge structure like the present invention, only the pipe can simply and cheaply be replaced. Furthermore, since the pipe holding layer 405 is smaller in the rigidity and the strength than the caster of the lining of the frame and the pipe, the pipe holding layer functions also as a release layer of the stress caused owing to the thermal deformation of the pipe.

Figure 22:
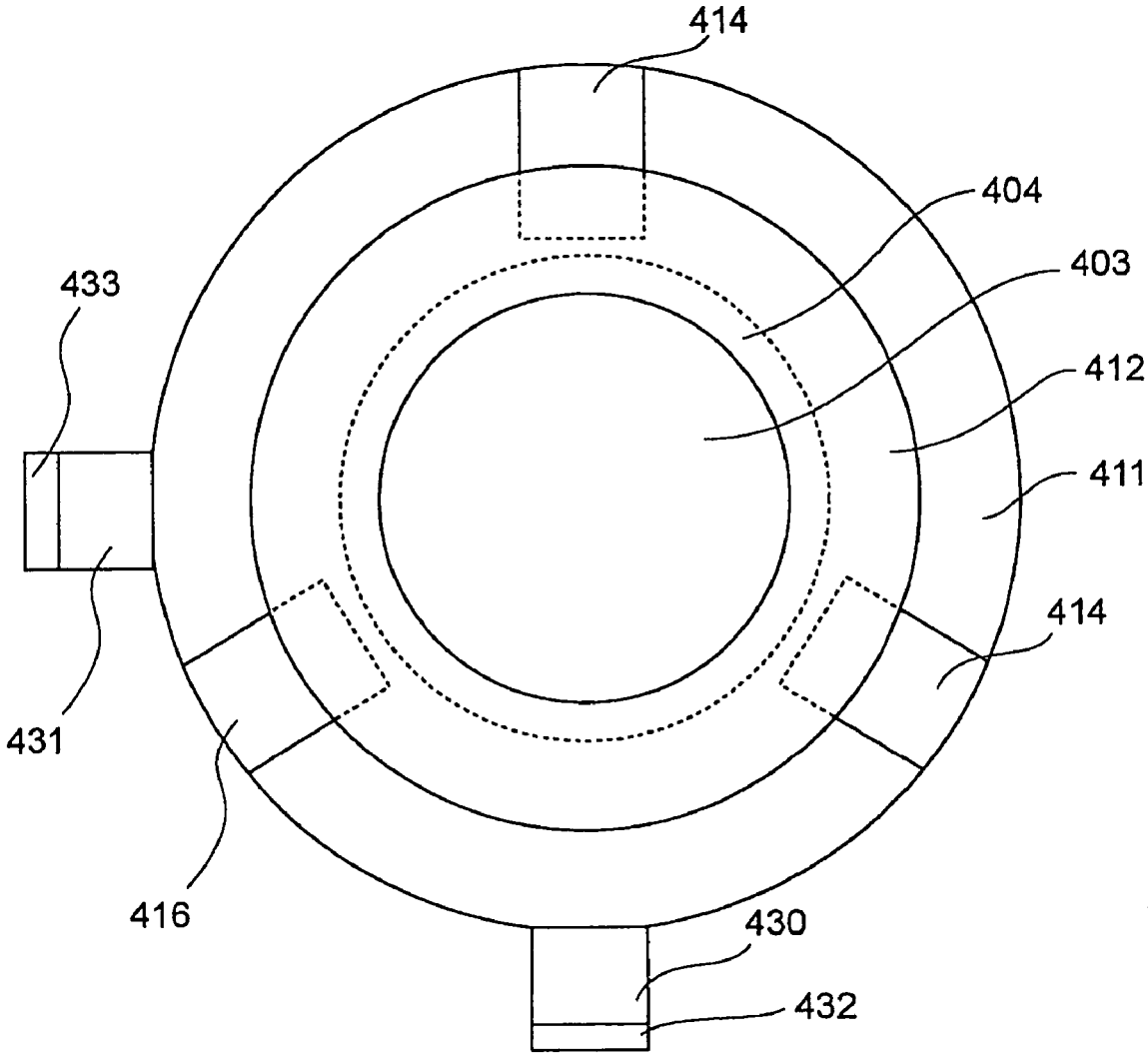
FIG. 22 is a schematic plan view when a structure of an upper end portion in a pipe of FIG. 21 is seen from a top surface.

FIG. 21 is a sectional view showing a structure of an upper end portion in the pipe 404, FIG. 22 being a schematic plan view where a structure of the upper end portion in the pipe 404 in FIG. 21 is seen from a top surface.

The pipe 404, as mentioned above, is buried through the filling material 405 that is a pipe holding layer in a lining layer including a layer made of a refractory member 402. In other words, the pipe 404 is inserted in a hole 411 disposed to the refractory member 402, and between the hole 411 and the pipe 404 the filling material 405 is inserted as the pipe holding layer.

The pipe 404 has a flange 412 on a top surface portion side of the container 401. From an inner wall of the frame 271, for example, three hooks 414 for holding a rear surface 413 of the flange 412 are protruded. The nail may be comprised of a round bar and the like made of an iron alloy.

On a top surface portion of the container 401, a flange 415 is disposed so as to surround the flange 412 that is a first flange and so as to have a flange receiving surface at a position higher than a height of a surface of the flange 412. A flange 417 of a pipe 416 that communicates with the flow path 403 is fastened to the flange 415 with a bolt, a clamp and the like. In the pipe 416, on an inner wall of an iron skin 416*a* a refractory member 416*b* is formed. In other words, a flange surface (a surface on a lower side) of the flange 417 (the second flange) of the pipe 416 and a flange surface (a surface on an upper side) of the first flange are separated through a distance t1. When t1 is set at 1 mm to 5 mm, sufficient stress relief capability and heat insulating property can be exhibited. Furthermore, since the pipe holding layer 405 is smaller in the rigidity and the strength than the caster of the lining of the frame and the pipe, the pipe holding layer functions also as a release layer of the stress caused owing to the thermal deformation of the pipe.

Between a surface of the flange 412 and a surface of the flange 417, a packing 418 having a first thickness t1 is inserted, and between a surface of the flange 415 and a surface of the flange 417 a packing 419 having a second thickness t2 thinner than the first thickness t1 is inserted. For the packing, ones having the fire resistant property may be selected. Furthermore, between a rear surface of the flange 412 and the hooks 414, for instance a sheet-like heat insulator 420 (such as ceramics paper) is inserted. Thereby, the heat insulating property between the hooks 414 and the first pipe is improved.

In the embodiment, due to the above structure in particular, the pipe 404 does not come into contact with the frame 271 that has high thermal conductivity. In particular, the flange 412 is held with the hook 414. Accordingly, since the heat that retained by the pipe 404 is difficult to diffuse, temperature of the pipe 404 can be prevented from decreasing. Therefore, the clogging of the pipe 404 can be prevented. In addition, in embodiment, in particular, since the packing 418 between the surface of the flange 412 and the surface of the flange 417 is thicker than the packing 419 between the surface of the flange 415 and the surface of the flange 417, a degree of freedom of the flange 412 to wobbling and vibration is higher. For this reason, cracks of the pipe 414, in particular, in the vicinity of the flange 412 can be prevented at utmost low possibility. Thereby the leakage of a gas from inside the container can be prevented.

Here, reference numeral 430 denotes a hole for injecting a filling material 405, and reference numeral 431 denotes a hole for letting out a gas when the filling material 405 is injected from the hole 430. The holes 430 and 431, respectively, are closed with caps 432 and 433. As in this embodiment, it is preferable to dispose at least two holes. When a filling material is injected into one of the holes, the gas can be released from the other hole and, in the same time, the completion of the filling can be informed.

Figure 23:
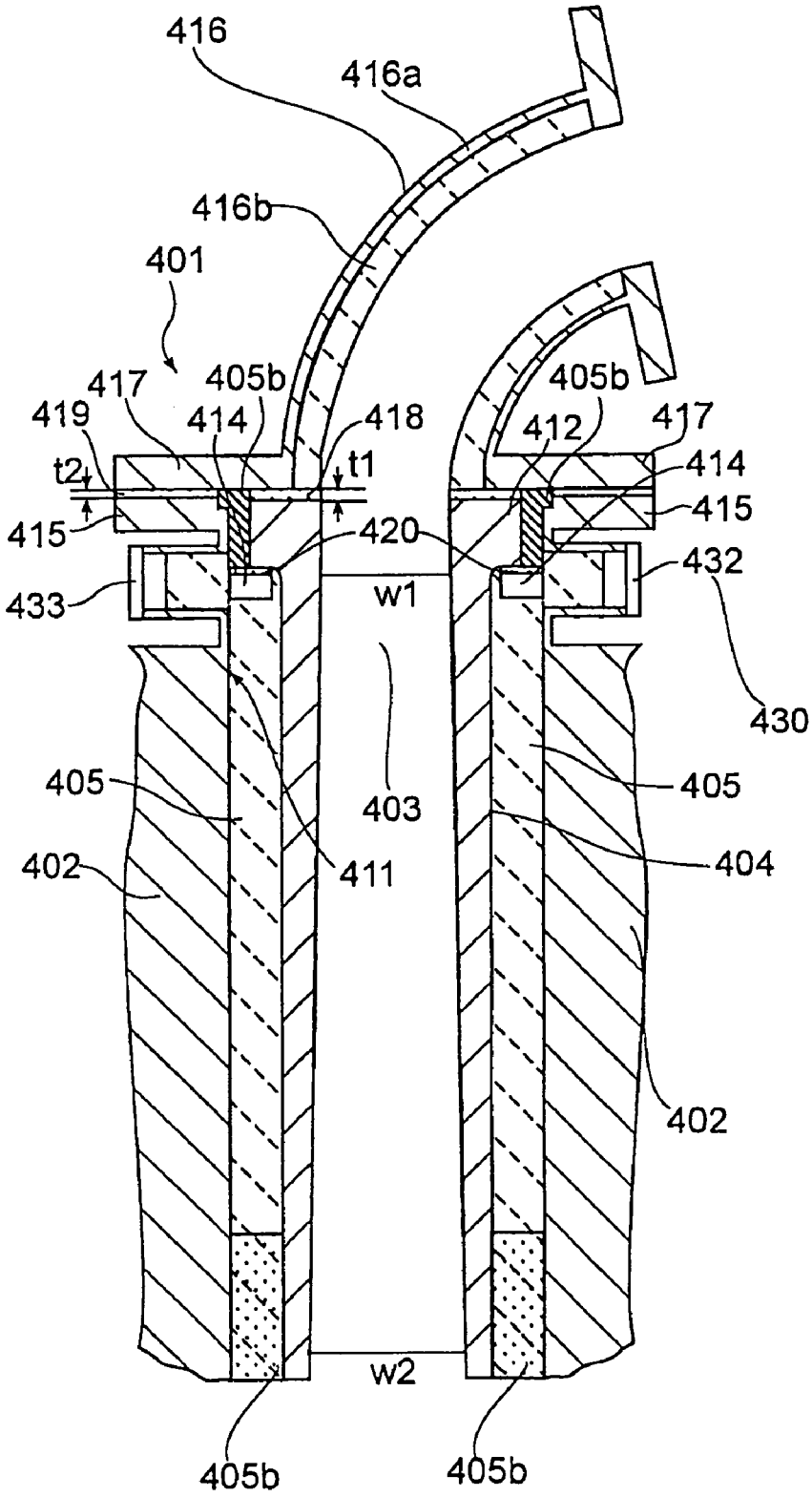
FIG. 23 is a partially enlarged cross-sectional view of the container according to an embodiment of the present invention.

FIG. 23 is a drawing showing another example of a container according to the invention. FIG. 23 as well, similarly to FIG. 21, is an enlarged vertical sectional view of a flow path of a container and a pipe connected thereto.

The container in the example also adopts a rigid pipe made of ceramics such as SiN or SiC as a first pipe and is provided with a filling material 405 that is a pipe holding layer. At a lower portion of the filling material 405, an impregnation layer 405*b* where the filling material is impregnated with a mixture of aluminum oxide and aluminum is provided. The mixture of aluminum and aluminum oxide is not necessarily large in the rigidity but strong in the tenacity and very large in the mechanical strength. Furthermore, it has the following property to the deformation. Accordingly, when such an impregnation layer 405*b* is provided as the pipe holding layer, the stress relief capability can be improved even further.

Furthermore, in this example, a tapered structure in which an outer diameter of the pipe 404 is straight (uniform except for the flange portion) but an inner diameter thereof is narrower at an upper portion and wider at a lower portion is adopted. Thereby, the strength of the pipe 404 is improved. Even in such a case, an inner diameter, as mentioned above, is preferably in the range of substantially 60 mm to 85 mm. In the example, w1 and w2 a reset at 60 mm and 80 mm respectively. When a diameter at a lower portion is made larger, even when molten metal large in the viscosity remains at the completion of feeding, the clogging and the like caused by the lowering of a temperature at a lower portion of the container can be prevented.

Figure 19:
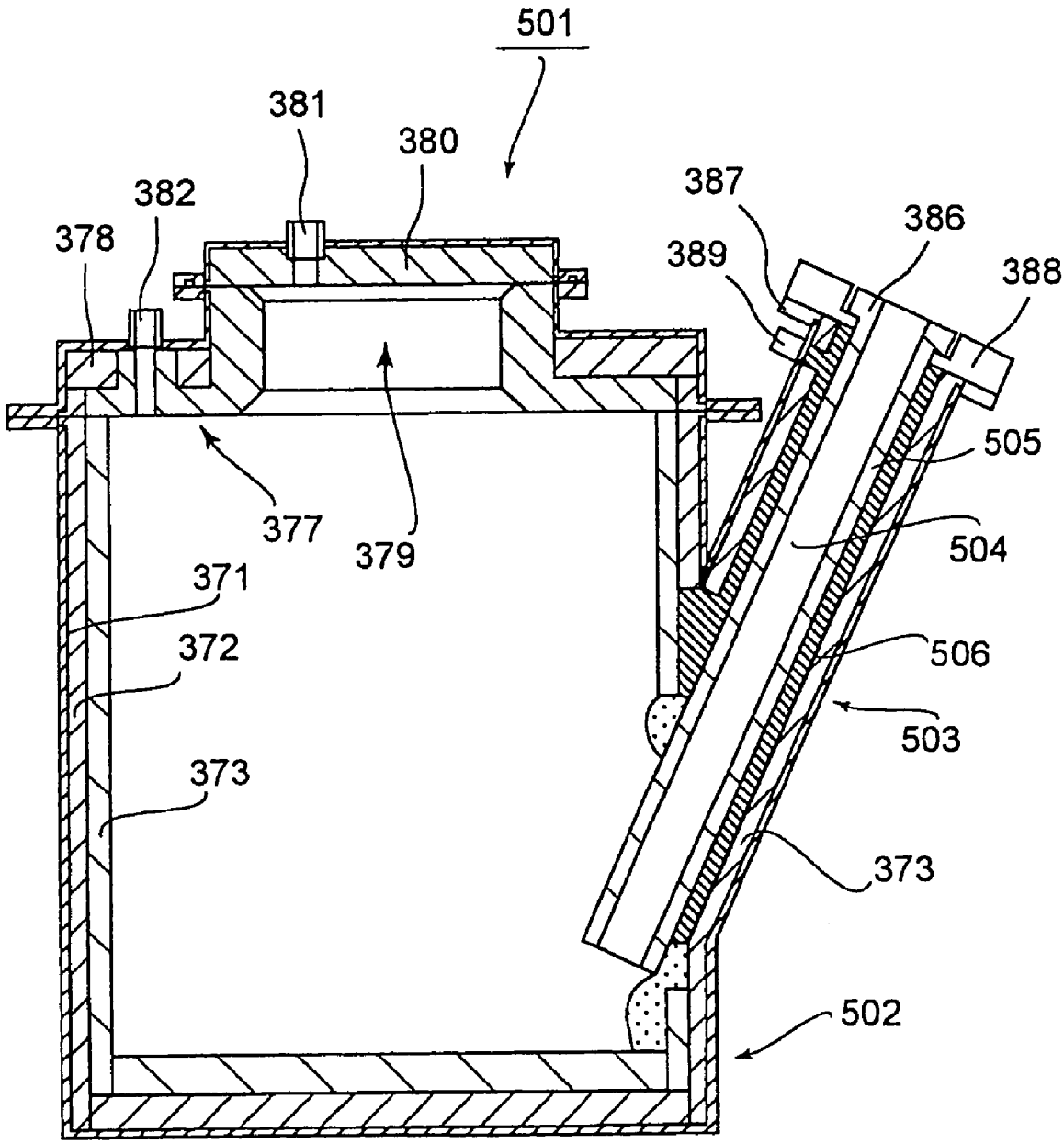
FIG. 19 is a cross-sectional view of the container according to an embodiment of the present invention.

FIG. 19 is a sectional view showing yet another embodiment of the present invention.

In the embodiment, an outer periphery of a body 502 is provided with a protruding portion 503 protruding like a sprinkler head (i.e. a protruding portion that gradually protrudes outward from a lower portion to an upper portion of a cylinder side surface). The protruding portion 503 has a flow path 504 therein and the flow path 504 is covered with a pipe 505 made of ceramics such as silicon nitride. Furthermore, the pipe 505 is buried through a filling material 506 in the refractory member 373. The filling material 506 is lower in the strength than the refractory member 373. Since the ceramics pipe 505 is excellent in the refractoriness, there is no need of disposing a refractory material to an inner wall. To an upper portion of the flow path 504, for example, a pipe made of iron with R shape is connected.

In addition, the container 501 is configured such that a large lid 377 is provided at an upper opening portion 378 of a bottomed cylindrical body 502 and, the large lid and the body 502 are connected with bolts provided between the flanges.

In addition, by inversely rotating the bolts with handles to release the fixation, the hatch 380 can be opened from the opening portion 379 in the large lid 378. Then, with the hatch 380 being opened, maintenance of the inside of the container 501 and insertion of a gas burner at the time of preheating can be performed through the opening portion 379.

At approximately the center of the aforementioned large lid 378, an opening portion 379 is provided, and a hatch 380 that freely opens and closes is disposed at the opening portion 379. A passage 380 for internal pressure adjustment for reducing and applying the pressure in the container 501 is provided at a center or a position slightly off from the center of the hatch 381. To the passage 381, a pipe for applying and reducing the pressure (not shown) is connected. To the end of the pipe, a pipe for applying pressure and a tank for storing a gas for applying pressure and a pump for applying pressure is connected, and to a pipe for reducing pressure, a pump for reducing the pressure is connected.

At a position adjacent to the hatch 380 on the large lid 378, a passage 382 for releasing pressure is disposed. To the passage 382, a pipe for applying and reducing the pressure (not shown) is connected. Thereby, for example, when the inside of the container 501 reaches a predetermined pressure or higher, the inside of the container 501 is released to the atmospheric pressure from a viewpoint of safety.

On the large lid 378, a passage being used for a liquid level sensor and a passage for inserting electrodes as a liquid level sensor may be disposed. It is thus possible to detect the maximum level of the molten metal in the container 501 by monitoring the conduction state between the electrodes, thereby enabling prevention of excessive supply of the molten metal to the container 501 with more reliability.

On the rear face of the bottom portion of the body 502, two channels having a cross section in a square shape into which, for example, a fork of the fork lift truck (not shown) is inserted and having a predetermined length, are disposed, for example, parallel to each other.

The flow path 504 thus surrounded with the pipe 505 extends through an opening 385 disposed at a position close to a bottom portion of the container body of an inner periphery of the body 502 toward an upper portion of an outer periphery of the body 502.

At an upper end portion of the pipe 505, a first flange 386 is disposed, and to the frame 371 a second flange 386 disposed opposite to a bottom surface of the first flange 387 is disposed so as to surround a periphery of the pipe 505. Between the first flange 386 and the second flange 387, a flange member 388 for receiving and fastening the ceramics pipe 505 is inserted. Reference numeral 389 denotes a hole for injecting the filling material 506.

In FIG. 19, a tip end portion of a lower portion of the pipe 505 is also in contact with a container inner wall, however, it may be constituted so that these are separated.

Figure 20:
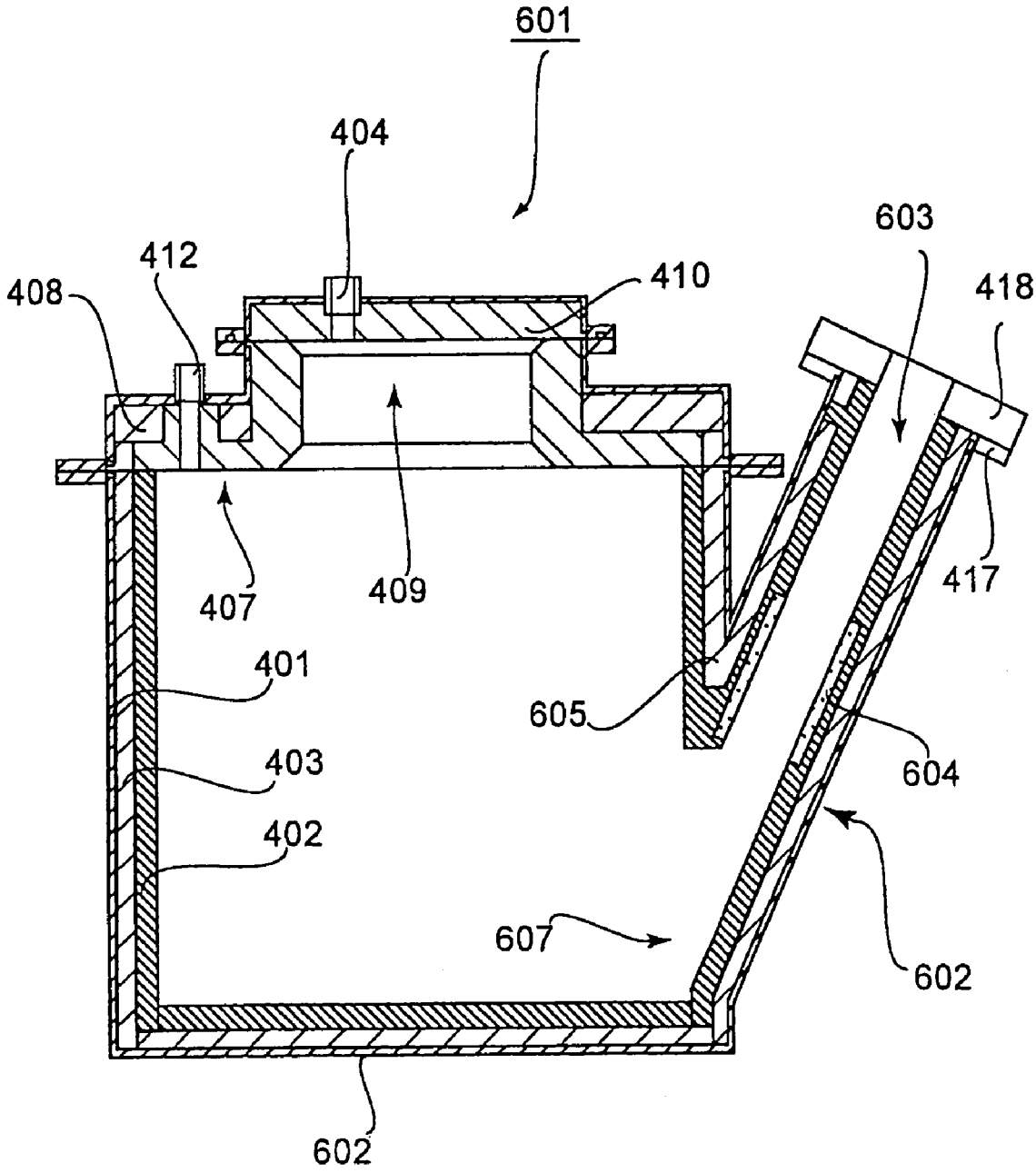
FIG. 20 is a cross-sectional view of the container according to an embodiment of the present invention.

FIG. 20 is a sectional view showing another embodiment of the present invention.

In the embodiment, an outer periphery of a body 601 is provided with a protruding portion 602 protruding like a sprinkler head (i.e. a protruding portion that gradually protrudes outward from a lower portion to an upper portion of a cylinder side surface). The protrusion 602 has a flow path 603 therein. The pipe 604 is buried in a part of the flow path 603 (here, a lower portion thereof) and fixed. A portion of the flow path 603 where the pipe is buried is a portion (for example, a portion of reference numeral 605) that is likely to cause cracking in a refractory member 402 or a lining 403, and the presence of the pipe can prevent a pressurized gas flowing from the cracked portion. The pipe 604 is preferably buried in the refractory member 402 or the lining 403 at the time of molding the container 601. In the embodiment also, to an upper portion of the flow path 603, for instance, a T-shaped or R-shaped iron pipe or a pipe having a reducer all of which are omitted from showing in the drawing is connected. Also in the connection, flanges may be connected through the packing by use of a bolt. The pipe may be made rotatable. As a mechanism that can realize the rotation, for example, one point of the flange in a connecting portion of the container and the pipe is rotatably connected with the flange on the container side and, in the same time, the flange of the pipe and the flange on the container side may be fixed by means of a clamp mechanism. Thereby, a container having small turning radius and excellent in the laying can be configured. Furthermore, as the pipe being capable of rotating, the maintenance of the flow path on the container side can be carried out with ease. On the container side, a holding member for holding a turned and bent pipe may be disposed. At this time, the holding member may be provided with means for fixing the pipe.

In addition, the container 601 is configured such that a large lid 407 is provided at an upper opening portion 408 of a bottomed cylindrical body 606 and, the large lid and the body 606 are connected with bolts provided between the flanges.

In addition, by inversely rotating the bolts with handles to release the fixation, the hatch 410 can be opened from the opening portion 409 in the large lid 408. Then, with the hatch 410 being opened, maintenance of the inside of the container 601 and insertion of a gas burner at the time of preheating can be performed through the opening portion 409.

At approximately the center of the aforementioned large lid 408, an opening portion 409 is provided, and a hatch 410 that freely opens and closes is disposed at the opening portion 409. A passage 410 for internal pressure adjustment for reducing and applying the pressure in the container 501 is provided at a center or a position slightly off from the center of the hatch 404. To the passage 404, a pipe for applying and reducing the pressure (not shown) is connected.

At a position adjacent to the hatch 410 on the large lid 408, a passage 412 for releasing pressure is disposed. To the passage 412, a pipe for applying and reducing the pressure (not shown) is connected. Thereby, for example, when the inside of the container 601 reaches a predetermined pressure or higher, the inside of the container 601 is released to the atmospheric pressure from a safety point of view.

On the large lid 408, a passage being used for a liquid level sensor and a passage for inserting electrodes as a liquid level sensor may be disposed (all are omitted from showing in the drawing). It is thus possible to detect the maximum level of the molten metal in the container 601 by monitoring the conduction state between the electrodes, thereby enabling prevention of excessive supply of the molten metal to the container 601 with more reliability.

On the rear face of the bottom portion of the body 602, two channels having a cross section in a square shape into which, for example, a fork of the fork lift truck (not shown) is inserted and having a predetermined length, are disposed, for example, parallel to each other.

Next, still another embodiment of the present invention will be described.

Figure 24:
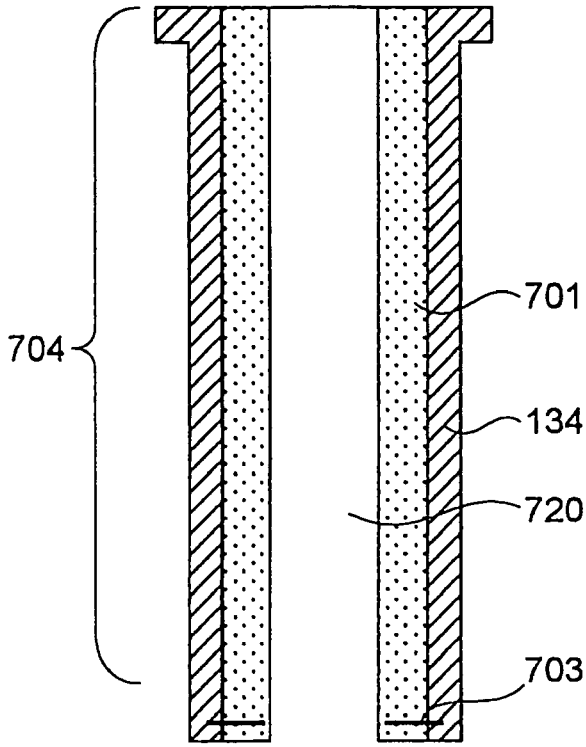
FIG. 24 is a cross-sectional view when a pipe involving another embodiment according to the invention is seen from a front.
Figure 25:
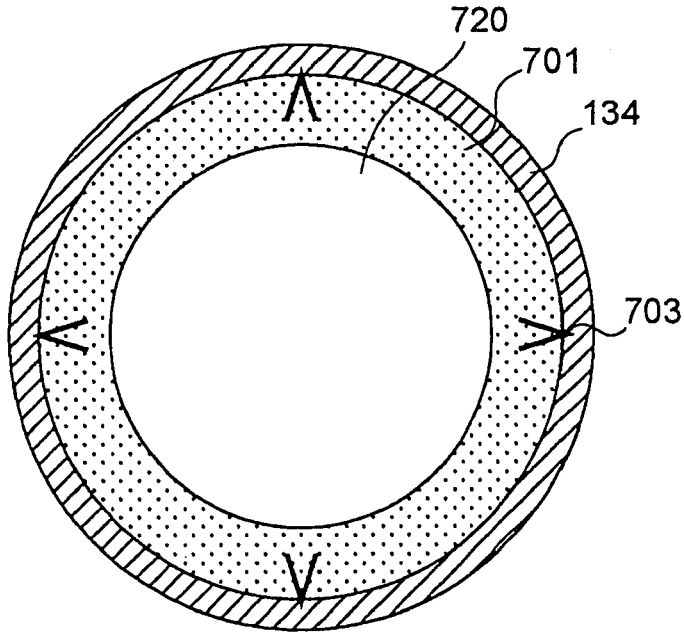
FIG. 25 is a cross sectional view of a pipe shown in FIG. 24.

FIG. 24 and FIG. 25 are drawings showing a configuration of a pipe that is inserted in a flow path involving the embodiment, FIG. 24 being a front sectional view, FIG. 25 being a plan sectional view. A pipe involving the embodiment is assumed to be a pipe 134 used in a container 101 shown in FIG. 7, FIG. 8 and FIG. 9, however, of course the configuration can be used in other types of container.

The pipe 134 is made of, for instance, iron, and on the inside thereof a lining layer 701 made of a refractory member is formed. Inside of the lining layer 701, a flow path 702 of a molten metal such as molten aluminum is formed. A preferable value of a diameter of the flow path 702 is, for instance, approximately 65 mm to 80 mm. Furthermore, materials of the pipe 134 and the lining layer 702 are, for example, as already disclosed. In the pipe 134 involving the embodiment, inside of the pipe 134, a holding member 703 for holding a refractory member that is the lining layer 702 is protrudingly disposed. The holding member 703 can be formed welding, for example, an iron rod to an inner wall of the pipe 134 to form a V-shape. For example, the V-shaped iron rods are disposed at four places with a separation of 90 degrees. Furthermore, the holding member 703 is disposed on a lower side of the pipe 134, more preferably at positions close to an approximately bottom end of the pipe 134, and positions other than the above, for example, an upper side of the inside of the pipe are made into a prohibiting region 704 where the holding member 703 is prohibited to be disposed.

According to the embodiment, the refractory member that is the lining layer 702 can be prevented from falling off the pipe 134. Furthermore, by disposing such holding member 703 on a lower side of the pipe 134, for instance, at positions close to an approximately bottom end of the pipe 134, even in the case of the lining layer 702 located on an upper position being cracked, the lining layer 702 does not fall. When the holding members 703 are disposed at a position close to a approximately bottom end of the pipe 134, not only a fall-preventive region can be expanded but also a welding operation of the holding member 703 becomes easier. Furthermore, as an upper side of the inner side of the pipe 134 the holding member 703 is disposed with a prohibiting region 704 where the holding member is prohibited to be disposed is provided, cracks or deformations of the member caused by different thermal expansion coefficients of the pipe 134 and the lining layer 702 can be prevented.

In the next place, another embodiment according to the present invention will be explained.

Figure 26:
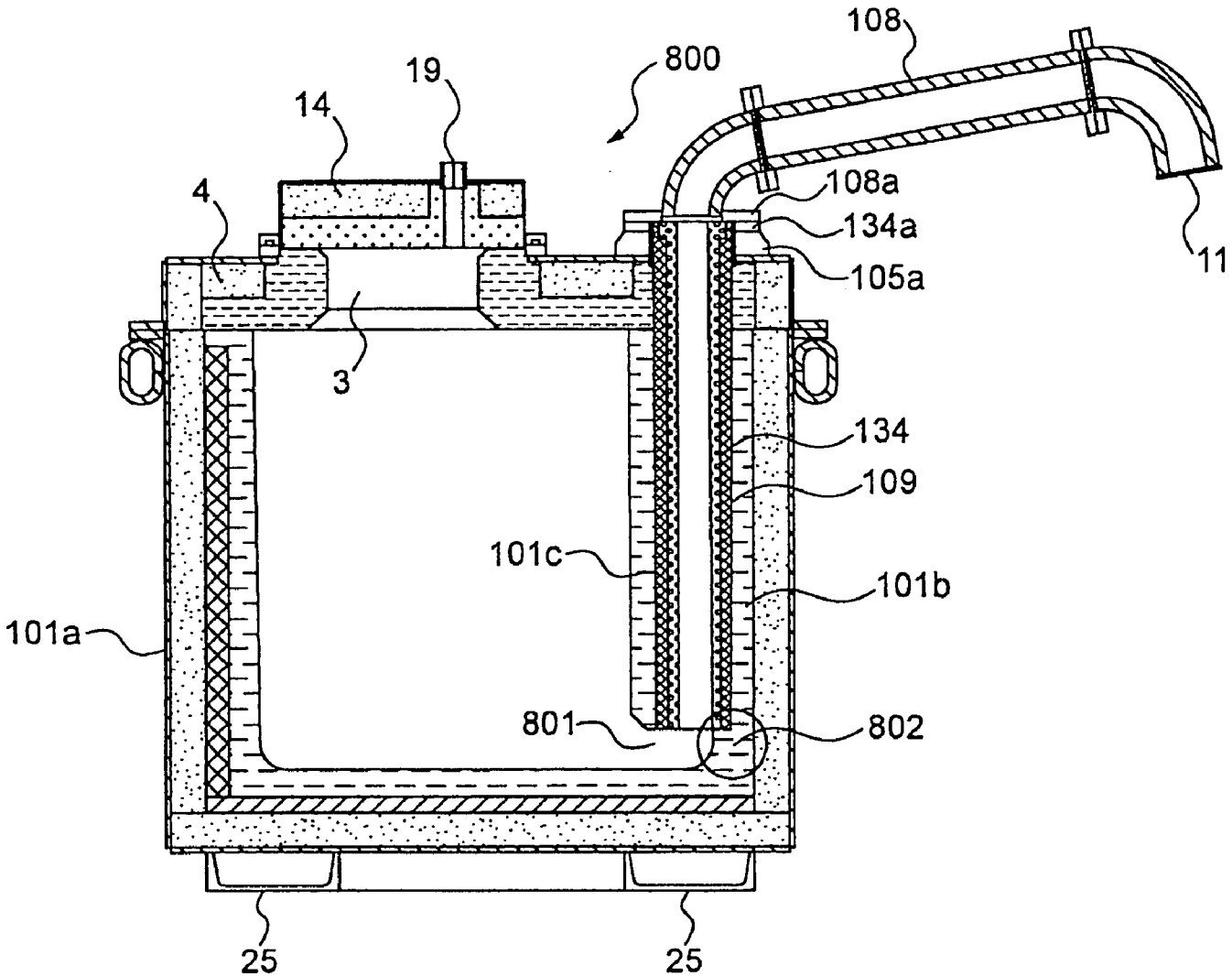
FIG. 26 is a cross-sectional view when a container involving another embodiment according to the invention is seen from a front.
Figure 27:
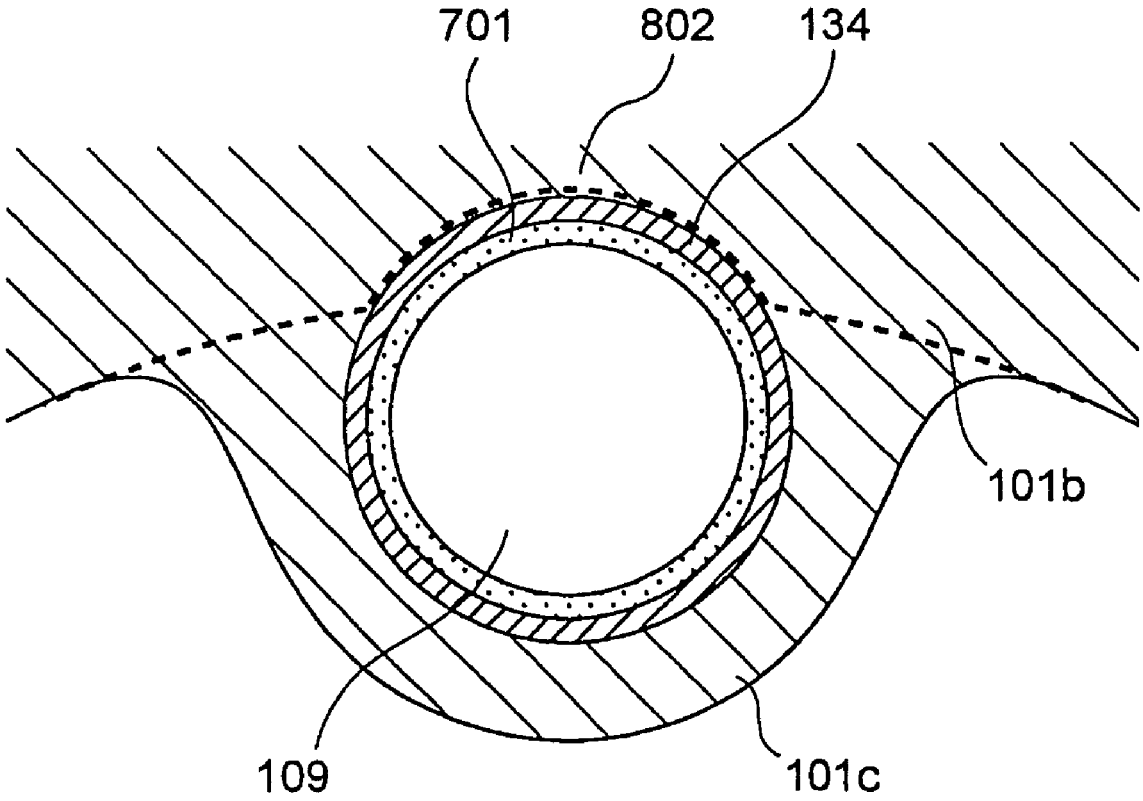
FIG. 27 is a partial cross sectional view when a container shown in FIG. 26 is seen from a plane.

FIG. 26 and FIG. 27 are drawings showing a configuration of a container of this embodiment. FIG. 26 is a front sectional view and FIG. 27 is a plan and partial sectional view. In a container 800, constituents same as that of the container shown in FIG. 7, FIG. 8 and FIG. 9 are given with the same reference numerals.

The container has a lining 101*b* having a protruding portion 101*c* protruding toward inside the container 800 in its inside of a frame 101*a* is disposed along a vertical direction. The lining 101*b* is preferably formed in a multi-layered structure of a refractory layer and a heat insulating layer. These materials may also be similar to that of the above embodiment.

Inside of the protruding portion 101*c*, a flow path 109 that penetrates through from a position close to an inner bottom portion of the container 101 to a top surface side of the container 101 is disposed. The flow path 109 is surrounded with a pipe 134 as seen, for example, in FIG. 24 and FIG. 25. To an upper portion of the flow path 109, for example, a pipe 108 is detachably connected with a bolt. The pipe 108 is, for example, made of an iron and has, for instance, a T-shape.

The flow path 109, as shown in FIG. 27 in particular, extends as far as to the lining 101*b* from the protruding portion 101*c* having a convex shape. However, at an opening portion 801 (disposed in the vicinity of a bottom portion of the container) that opens on an inner wall side of the container and is connected with the flow path 109, there is no such a portion that extends to the lining 101*b*. Resultantly, in the portion, a stepped portion 802 protruded from the lining 101*b* is disposed. Since the stepped portion 802 creates a gap between a bottom surface of the container and a lower end surface of the pipe 134 (corresponding to, for example, a height of the opening 801), disposed as a holding member (disposed integrally with the lining) for holding a lower end surface of the pipe 134.

In the embodiment, by disposing the stepped portion 802 as a holding member that holds the pipe 134, the pipe 134 and the lining layer that may be formed inside of the pipe can be prevented from falling. In addition, in the manufacturing process of the container, there is an effect in that when the pipe 134 is inserted in the flow path 109 and fixed, a jig for fixing a position becomes unnecessary.

In the embodiment, the stepped portion 802 is realized by changing a shape of the lining 101*b*. However, of course, a special holding member from the lining may be disposed separately.

In the next place, a still another embodiment according to the invention will be explained.

Figure 28:
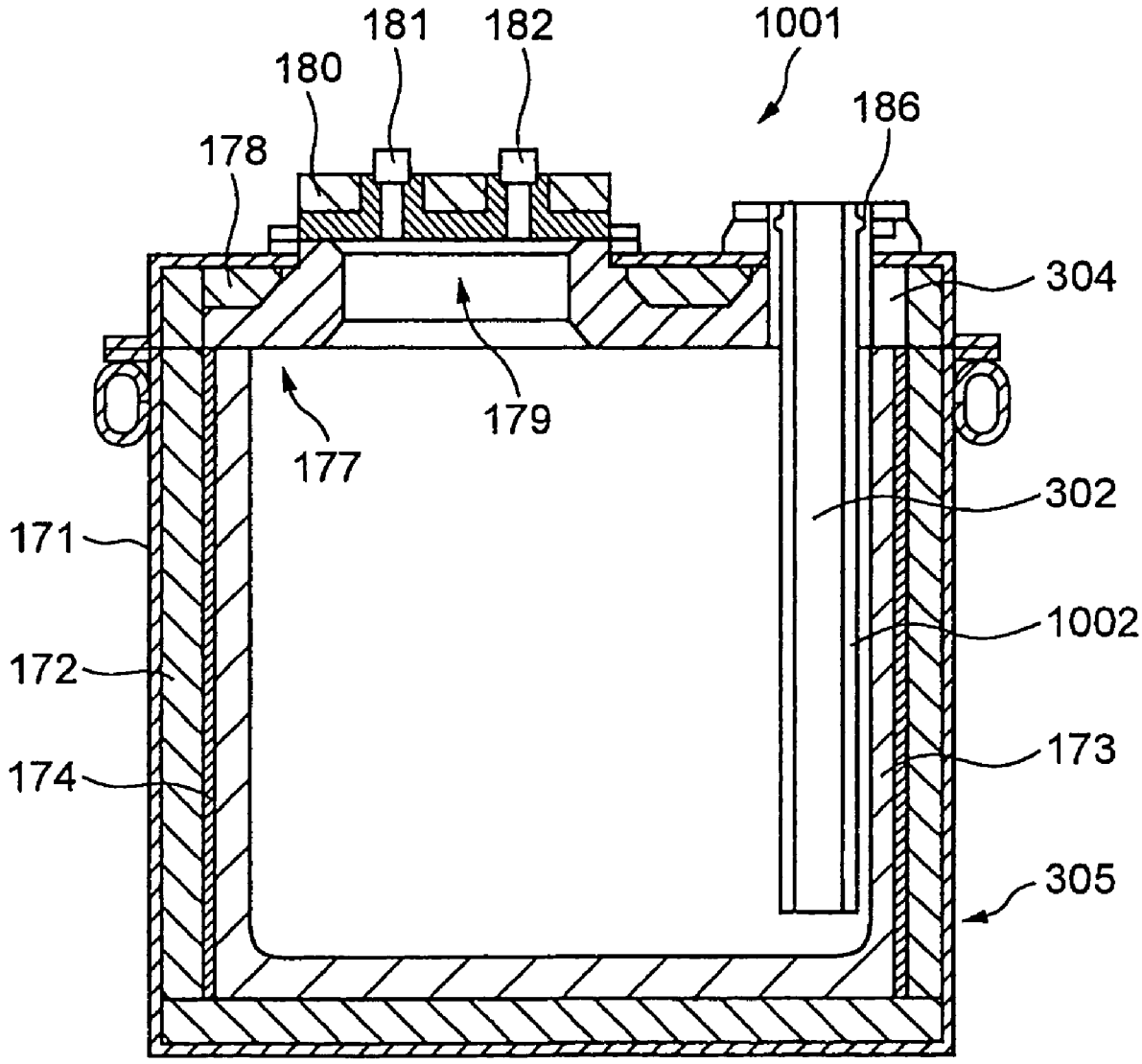
FIG. 28 is a cross-sectional view when a container involving another embodiment according to the invention is seen from a front.
Figure 29:
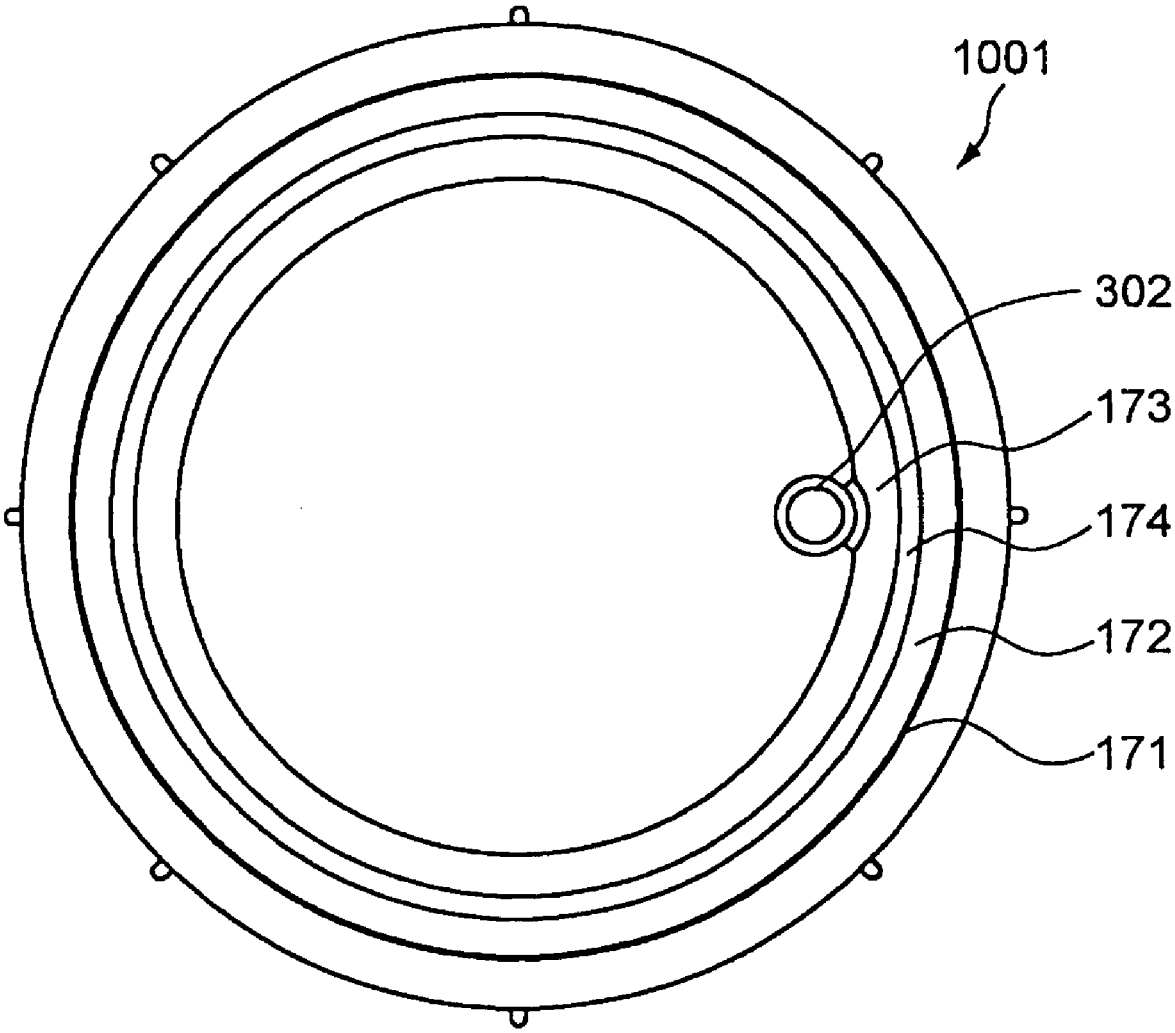
FIG. 29 is a plan view when a lid is removed from a container shown in FIG. 28.

FIG. 28 is a front sectional view showing a configuration of a container involving the embodiment, and FIG. 29 is a plan view when a lid of the container is being removed.

A container 1001 of the embodiment, although the configuration thereof is basically the same as that of the container 301 shown in FIG. 17, the container is different in that a pipe 1002 is in contact with a refractory member 173 disposed as a lining. The pipe 1002 is disposed so as to come into contact with the refractory member 173 as the lining along a flowing direction of a molten metal in the pipe 1002. The pipe 1002 is made of metals or ceramics.

The container 1001 of the present he embodiment, since the pipe 1002 is constituted so as to come into contact with the refractory member 173 as the lining, the pipe 1002 is located at a position most distant from a gas burner that is inserted by opening a hatch 180 at the time of preheating and resultantly becomes difficult to be thermally affected by the gas burner. According to the present invention, since the pipe 1002 is in contact with the refractory member 173 disposed as a lining, the pipe can be prevented from being mechanically destroyed due to the vibration of the pipe caused by such vibration, for example, at a time of transportation. Still furthermore, at the least inclination, residual molten metal in the container 1001 can be effectively removed.

In the next place, a still another embodiment according to the invention will be explained.

Figure 30:
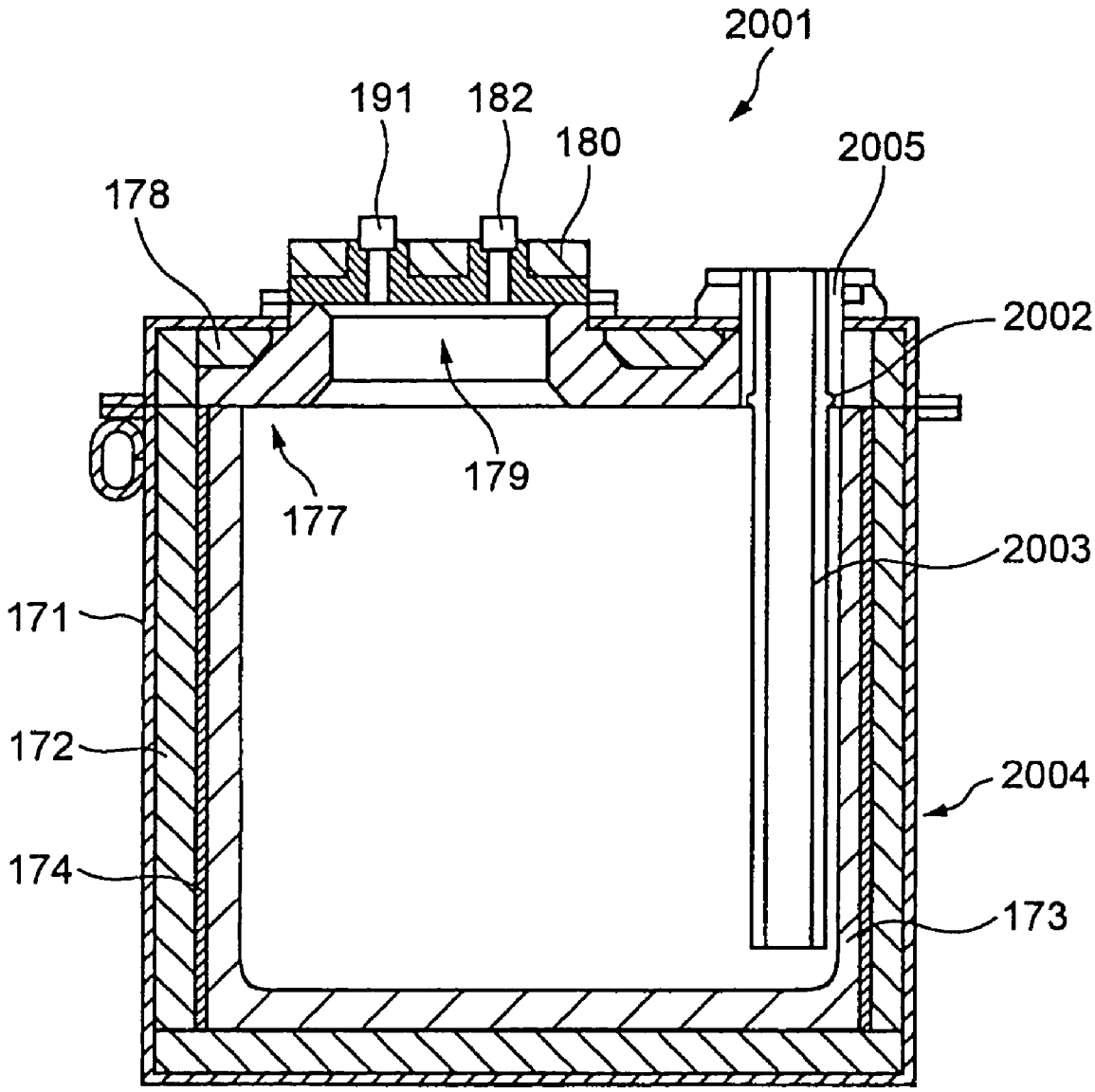
FIG. 30 is a cross-sectional view when a container involving another embodiment according to the invention is seen from a front.
Figure 31:
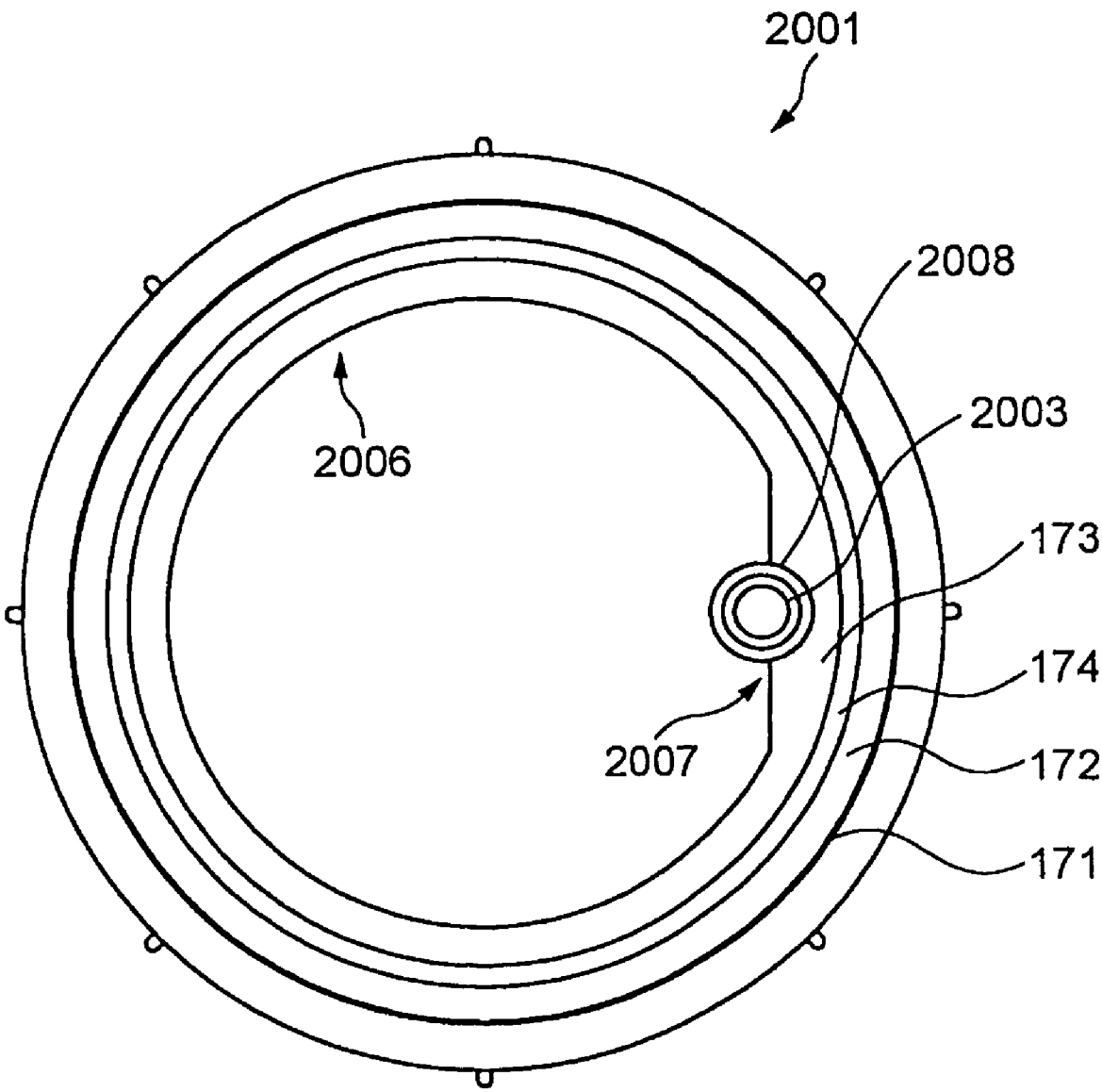
FIG. 31 is a plan view when a lid is removed from a container shown in FIG. 30.

FIG. 30 is a front sectional view showing a configuration of a container involving the embodiment, and FIG. 31 is a plan view when a lid of the container is being removed.

A container 2001 involving the embodiment, though constituted fundamentally similarly to the container 1001 shown in FIG. 28 and FIG. 29, is different therefrom in the following points.

That is, a large lid 178 in the container 2001 is detachably attached to a container body 2004 so as to be removed from the container body 2004 with a state that a pipe 2003 for flowing a molten aluminum between the inside and the outside of the container being disposed inside of the container body 2004.

Specifically, the pipe 2003 has, at a position having a height same as that of a plane of an upper opening in the container body 2004, a flange portion 2002 for holding the pipe 2003 with a plane of the upper opening in the container body 2004. Furthermore, the large lid 178 is provided with a passage 2005 through which the pipe 2003 penetrates. The pipe 2003 is connected through the passage 2005 to a not shown R-shaped pipe (such as shown with reference numeral 8 in FIG. 1 and it may be of course a T-shape). The large lid 178 is detachably attached to the container body 2004 by fixing a flange of an outer periphery of the large lid 178 and a flange of an outer periphery of the container body 2004 with bolts.

Figure 32:
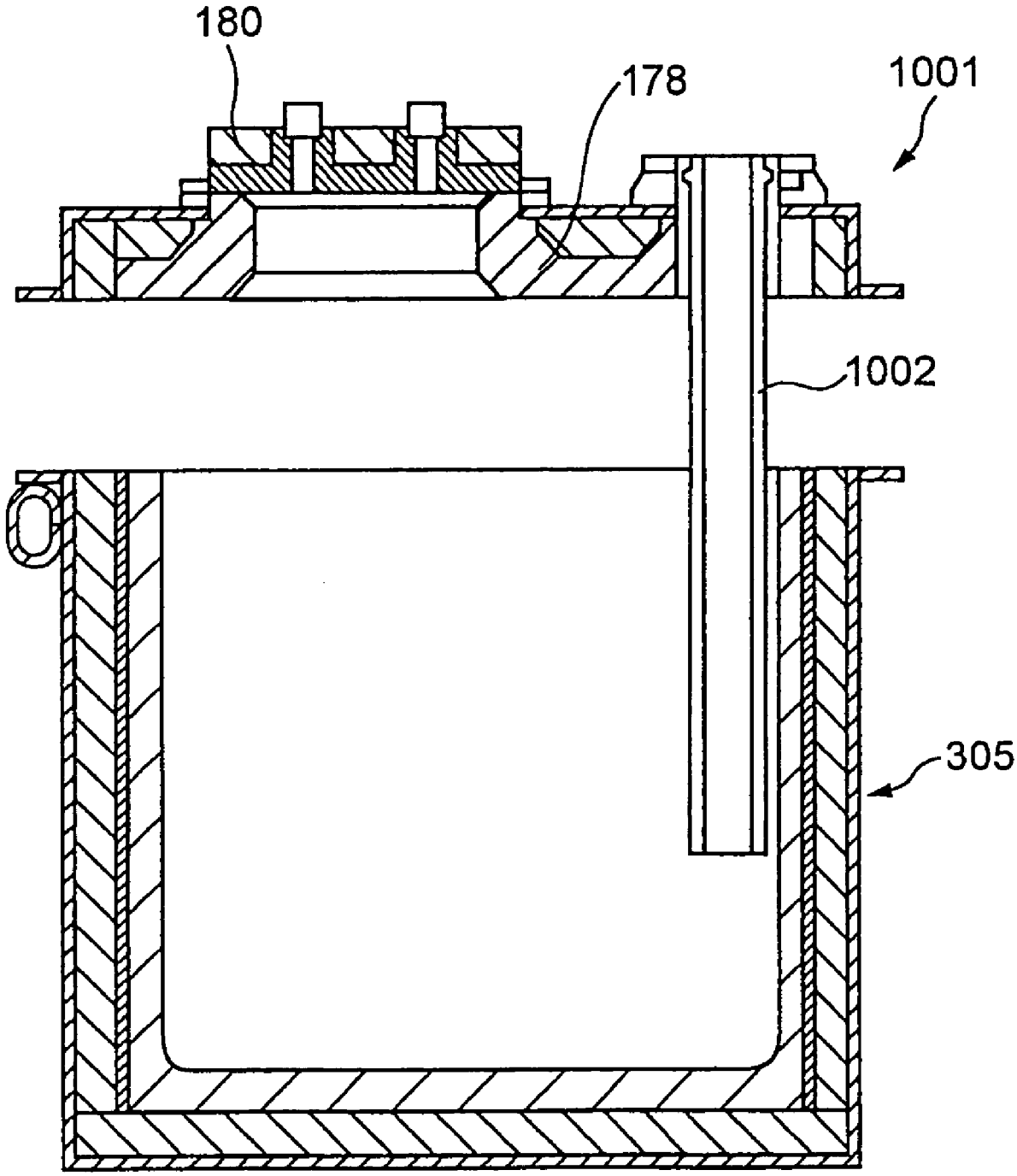
FIG. 32 is a drawing showing a state where a container body and a lid is removed in a container in FIG. 28.
Figure 33:
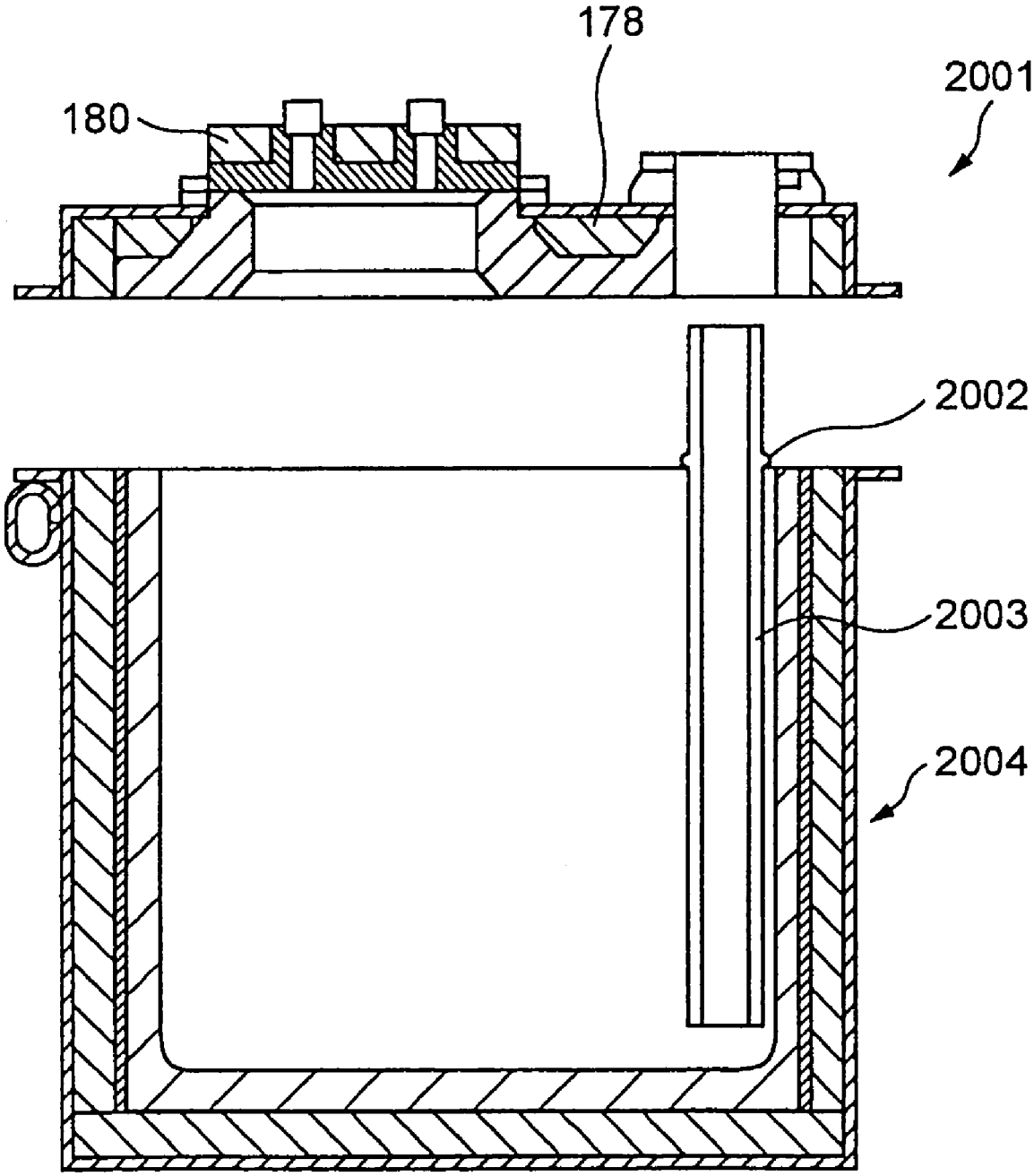
FIG. 33 is a drawing showing a state where a container body and a lid are separated in a container in FIG. 30.

That is, in the container 1001 shown in FIG. 28 and FIG. 29, when the large lid 178 is being removed from the container body 305, since, as shown in FIG. 32, the pipe 1002 is integrally attached to the large lid 178, it is troublesome operation to remove the large lid 178. On the other hand, according to the container 2001 of the present embodiment, as shown in FIG. 33, the large lid 178 can be removed as the pipe 2003 being left on the container body 2004 side. As the large lid 178 being able to be removed easily, the maintenance can be carried out easily. In the maintenance, for instance, the large lid 178 is removed from the container 2001 and the molten metal attached to the inside of the container body 2004 (oxide of aluminum) is removed.

Furthermore, in the container 2001 involving the embodiment, as shown in FIG. 31 in particular, an inner periphery of a lining 2006 is cylindrically formed, however, a position that the pipe 2003 comes into contact is provided with a planar portion 2007. On the planar portion 2007, a dent 2008 is formed. The dent 2008 has a size of a radius of the pipe 2003 and an approximately half of the pipe 2003 is fitted into the lining 2006 side. Thereby, the pipe 2003 is more solidly attached to the lining 2006, and a contact area of the pipe 2003 and the lining 2006 becomes larger.

It is preferable that the pipe 2003 is made of metals or ceramics.

In the next place, still another embodiment according to the invention will be explained.

Figure 34:
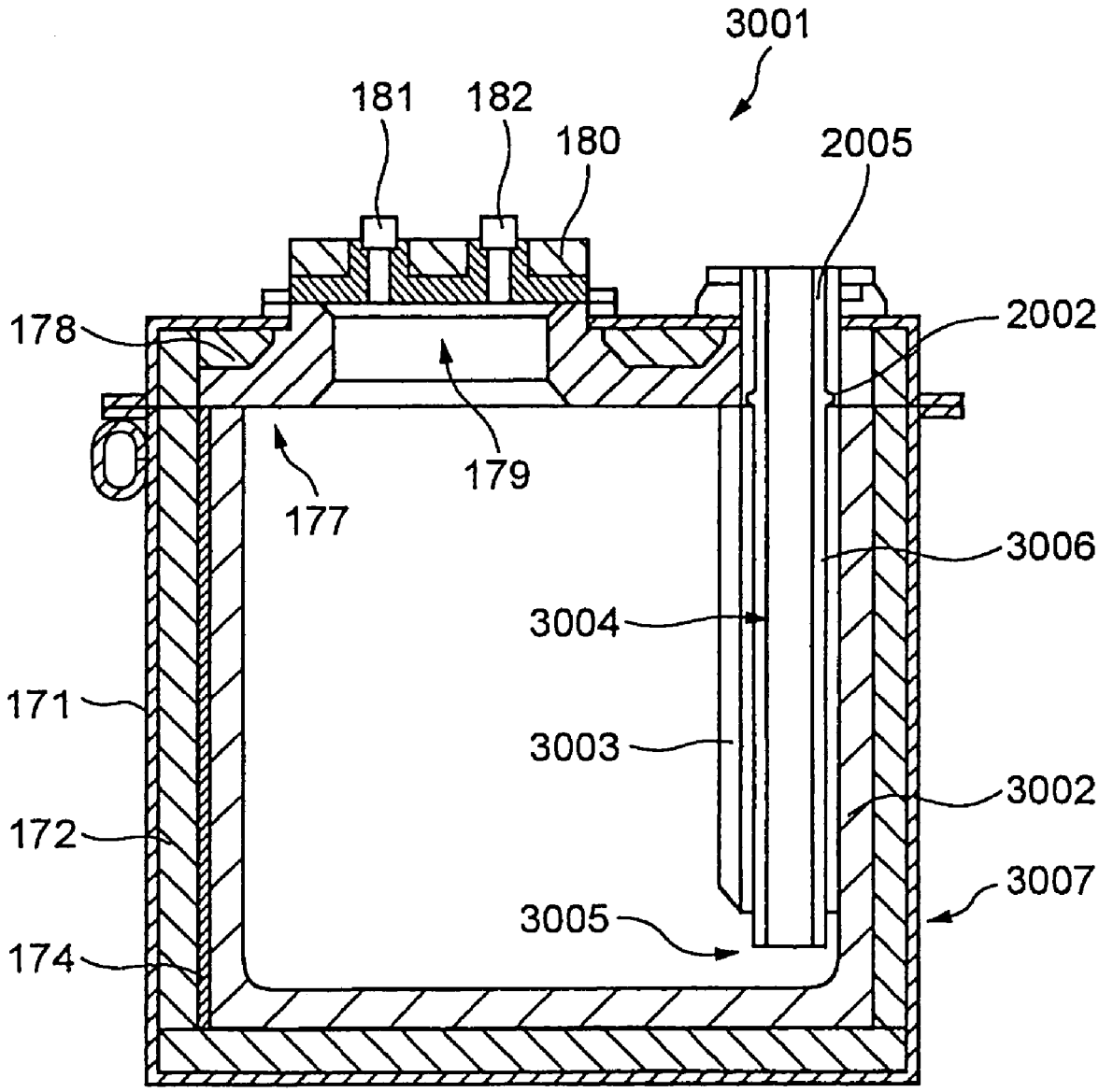
FIG. 34 is a cross-sectional view when a container involving yet another embodiment according to the invention is seen from a front.
Figure 35:
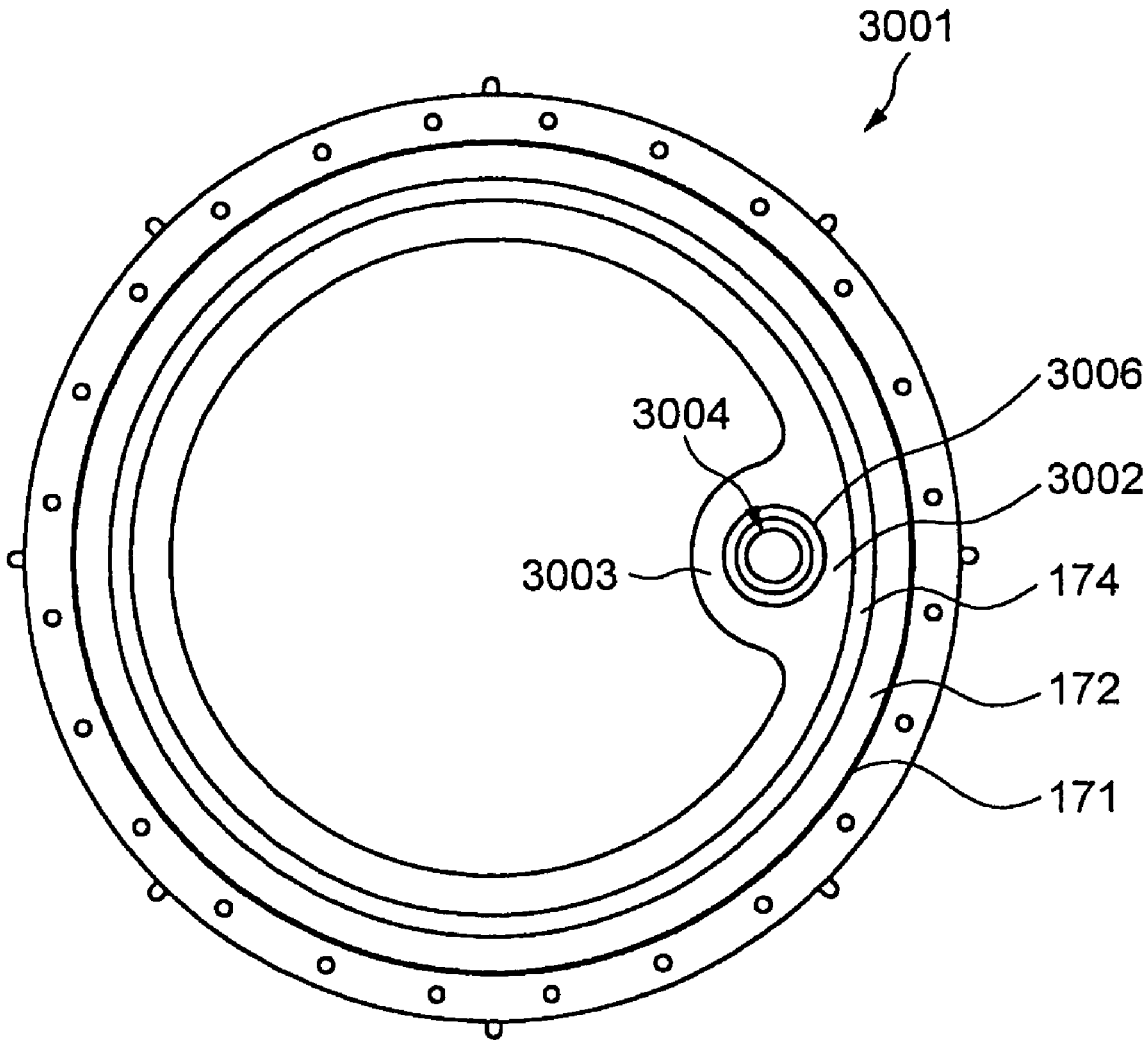
FIG. 35 is a plan view when a lid is removed from a container shown in FIG. 34.

FIG. 34 is a front sectional view showing a configuration of a container involving the embodiment, and FIG. 35 is a plan view when a lid of the container is being removed.

A container 3001 relating to the embodiment basically being constituted similar to the container 2001 shown in FIG. 30 and FIG. 31, however, the embodiment is different in a following point.

That is, a refractory member as a lining is disposed inside of the frame 171, 3002. On an inner surface side of the refractory member 3002, a protruding portion 3003 that protrudes and extends in a up and down direction, and inside of the protruding portion 3003 a flow path 3004 for flowing a molten metal between the inside and outside of the container is provided therein. In the vicinity of a bottom surface of the container 3001, an opening 3005 provided on an inner surface side of the container 3001 and communicating with a flow path 3004 is disposed. Then, in the flow path 3004, a pipe 3006 is inserted. The pipe 3006 is exposed to an inner surface side of the container 3001 at the opening 3005. Furthermore, the protruding portion in the vicinity of a lower opening of the pipe preferably has a tapered shape so that the inside of the container may become wider. Thereby, the accessibility from the inside of the container toward the lower portion of the pipe can be improved at the time of the maintenance of the container. Thereby, heat of the molten aluminum in the container 3001 is conducted from an exposed portion of the pipe to the pipe 3006 as a whole, thereby the clogging caused by the molten aluminum flowing the pipe 3006 can be prevented.

Figure 36:
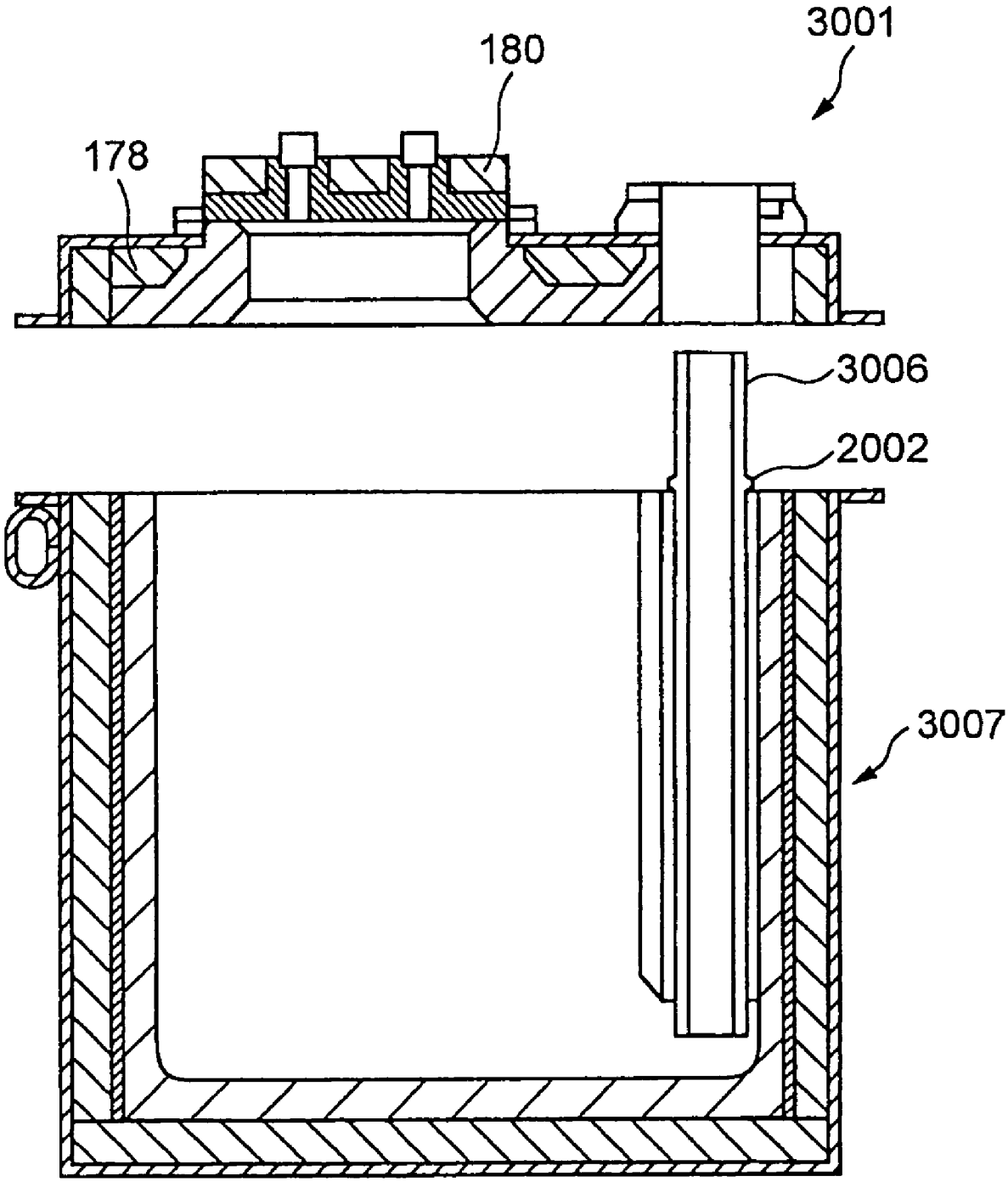
FIG. 36 is a drawing showing a state where a container body and a lid are removed from a container in FIG. 34.

On the other hand, in the container 3001 of the present embodiment, the large lid 178 can be removed as the pipe 3007 being left on the container body 3006 side, as shown in FIG. 36. As the large lid 178 can be removed easily, the maintenance can be carried out easily.

Furthermore, it is preferable that the pipe 3006 is made of metals or ceramics.

INDUSTRIAL AVAILABILITY

As explained above, according to the present invention, leaking of a gas for applying pressure to a flow path for flowing a molten metal between the inside and outside of a container hardly occurs. Accordingly, the molten metal can be stably supplied. Furthermore, the quantitative property of molten metal supply can be improved. In addition, according to the present invention, since a pipe becomes replaceable to a container, maintenance cost of the container can be reduced to a large extent.

The invention claimed is:

1. A container capable of storing a molten metal and supplying the molten metal to an outside using a pressure difference between an inside and an outside of the container, comprising:

a frame;

a lining, having a flow path for flowing the molten metal therein, the lining being provided inside of the frame and at least a part thereof is surrounded by a member restricting a flow of a gas; and a first pipe forming the flow path when being inserted into a hole for forming the flow path, the first pipe having a first flange disposed at an upper surface of the container and a hook for holding a rear surface of the first flange protruding from an inner wall of the frame.

2. A container capable of storing a molten metal and supplying the molten metal to an outside using a pressure difference between an inside and an outside of the container, comprising:

a frame;

a lining, provided inside the frame, having a flow path for causing the molten metal flow from the inside to the outside of the container; and a pipe disposed to surround at least a part of the flow path, the pipe including a first pipe forming the flow path when being inserted into a hole for forming the flow path, the first pipe having a first flange disposed at an upper surface of the container and a hook for holding a rear surface the first flange protruding from an inner wall of the frame.

3. The container as set forth in claim 2, wherein the pipe is made of a metal and a lining layer made of a refractory member is formed inside of the pipe.

4. The container, as set forth in claim 2, wherein the pipe is made of a ceramics.

5. The container, as set forth in claim 2, wherein the lining is formed such that to extend to an upper direction and to a lower direction and to have a protruding portion protruding to an inner wall side of the container, and the flow path is formed inside the protruding portion.

6. The container, as set forth in claim 5, wherein the pipe has an opening at a lower side surface, the protruding portion is provided above the lower side surface and no protruding portion is provided below the lower side surface thereof.

7. The container, as set forth in claim 2, further comprising:

a pipe holding layer disposed between the hole for forming the flow path and the pipe, and having a strength lower than that of the lining.

8. The container, as set forth in claim 2, wherein the frame has:

a flange receiving portion where an upper opening portion of the flow path for the molten metal being located close to a center thereof; and a second pipe having a second flange being connected to the flange receiving portion so that the second pipe is connected to the flow path at the upper opening portion;

wherein the pipe is built into the frame so that an end face thereof is disposed at a lower position than an upper opening surface of the upper opening portion.

9. The container, as set forth in claim 2, further comprising:

a second pipe, having a second flange, communicating with the flow path;

a flange receiving portion provided at an upper surface portion of the container to surround the first flange, a surface of the second flange being disposed apart from a surface of the first flange with a predetermined distance there-between;

a first packing, having a first thickness, being inserted between the surface of the first flange and the surface of the second flange; and a second packing, having a second thickness thinner than the first thickness, being inserted between the surface of the flange receiving portion and the surface of the second flange.

10. The container, as set forth in claim 8, the first pipe is disposed without touching the flange receiving portion and the second flange directly.

11. The container, as set forth in claim 8, wherein an inner diameter of the flange receiving portion is larger than an outer diameter of the first pipe.

12. The container, as set forth in claim 8, further comprising:

a heat insulating member provided at an outer periphery of the first flange and the frame.

13. The container, as set forth in claim 8, further comprising:

at least two ports provided close to a lower side of the flange receiving portion of the frame.

14. A container capable of storing a molten metal and supplying the molten metal to an outside using a pressure difference between an outside and an inside of the container, comprising:

a frame;

a lining, provided inside of the frame, having a flow path for causing the molten metal flow from the inside to the outside of the container; and a pipe being disposably inserted into a hole for forming the flow path formed in the lining, the pipe including a first pipe forming the flow path when being inserted into the hole for forming the flow path, the first pipe having a first flange disposed at an upper surface of the container and a hook for holding a rear surface of the first flange protruding from an inner wall of the frame.

15. The container, as set forth in claim 14, further comprising:

a pipe holding layer disposed between the pipe and the lining, having a strength lower than that of the lining.

16. A container, capable of storing a molten metal, comprising:

a container body having a first opening at an upper portion thereof;

a pipe for causing the molten metal flow therein, being extended from the container body to an outside through the first opening the pipe including a first pipe forming a flow path when being inserted into a hole for forming the flow path, the first pipe having a first flange disposed at an upper surface of the container and a hook for holding a rear surface of the first flange protruding from an inner wall of the frame; and a lid, having a passage for inserting the pipe therethrough, provided to cover the first opening portion and detachably disposed to the container so that the lid is capable of being detached from the container while the pipe is being held onto the container.

* * * * *